US005174663A

United States Patent [19]

Asada et al.

[11] Patent Number: 5,174,663

[45] Date of Patent: Dec. 29, 1992

[54] WIRE DOT PRINT HEAD AND METHOD FOR MANUFACTURING SAME

[75] Inventors: Takashi Asada; Osamu Koshiishi; Yasuhiko Nakazawa; Masaki Shimomura, all of Suwa, Japan

[73] Assignee: Seiko Epson Corporation, Tokyo, Japan

[21] Appl. No.: 449,691

[22] Filed: Dec. 11, 1989

[30] Foreign Application Priority Data

| | | | |
|---|---|---|---|
| Dec. 9, 1988 | [JP] | Japan | 63-311271 |
| Jan. 17, 1989 | [JP] | Japan | 1-8259 |
| Jan. 20, 1989 | [JP] | Japan | 1-11602 |
| Jan. 30, 1989 | [JP] | Japan | 1-20101 |
| Apr. 24, 1989 | [JP] | Japan | 1-103718 |
| May 8, 1989 | [JP] | Japan | 1-114622 |

[51] Int. Cl.[5] ..... B41J 2/24

[52] U.S. Cl. ..... 400/124; 101/93.05

[58] Field of Search ..... 400/124, 124 GT, 167; 101/93.02, 93.05

[56] References Cited

U.S. PATENT DOCUMENTS

| | | | |
|---|---|---|---|
| 4,230,038 | 10/1980 | Hebert | 400/124 |
| 4,367,962 | 1/1983 | Gaboardi | 400/124 |
| 4,653,943 | 3/1987 | Sakaida et al. | 400/124 |
| 4,687,355 | 8/1987 | Ikehata et al. | 400/124 GT |
| 4,767,227 | 8/1988 | Mitsuishi et al. | 400/124 |

FOREIGN PATENT DOCUMENTS

| | | | |
|---|---|---|---|
| 83464 | 5/1982 | Japan | 400/124 |
| 126671 | 8/1982 | Japan | 400/124 |
| 187268 | 11/1982 | Japan | 400/124 |
| 42970 | 3/1984 | Japan | 400/124 |
| 78863 | 5/1984 | Japan | 400/124 |
| 198258 | 10/1985 | Japan | 400/124 |
| 228169 | 11/1985 | Japan | 400/124 |
| 193865 | 8/1986 | Japan | 400/124 |
| 268458 | 11/1986 | Japan | 400/124 |
| 53844 | 3/1987 | Japan | 400/124 |
| 234944 | 10/1987 | Japan | 400/124 |
| 297158 | 12/1987 | Japan | 400/124 |
| 56462 | 3/1988 | Japan | 400/124 |

*Primary Examiner*—David A. Wiecking
*Attorney, Agent, or Firm*—Blum Kaplan

[57] ABSTRACT

An improved wire dot print head for increased integrated density is provided. The wire dot print head includes a frame. A plurality of drive coils are mounted within the frame. A lever for driving print wires has a print wire mounted at one end and its other end formed as a hook to act as a rotation support member. A yoke has salients formed thereon equal in number to that of the levers disposed on its end surface. The rotation support member of each lever is retained with a recess formed within a respective yoke and an end surface of the frame and is affixed in place by a retainer spring. When an excitement current flows through the coil, the lever is caused to move so that the print wire rotate about the rotation support member causing the print wires to strike a platen.

18 Claims, 17 Drawing Sheets

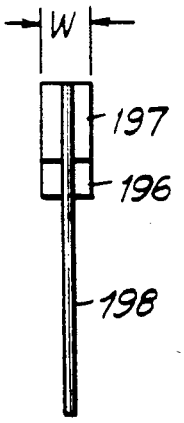
FIG. 8(a)
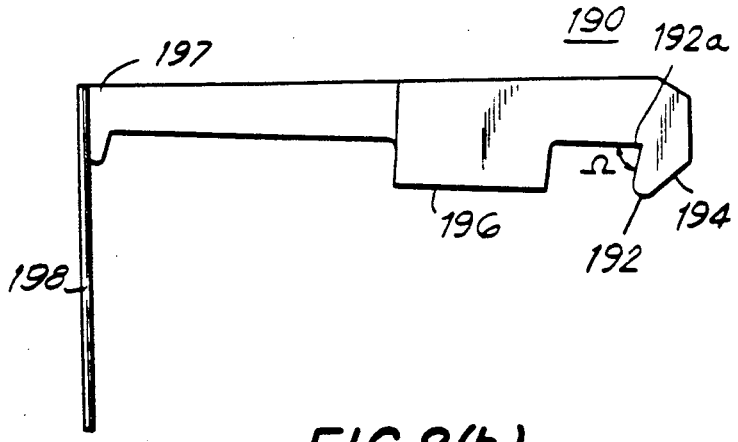
FIG. 8(b)
FIG. 9
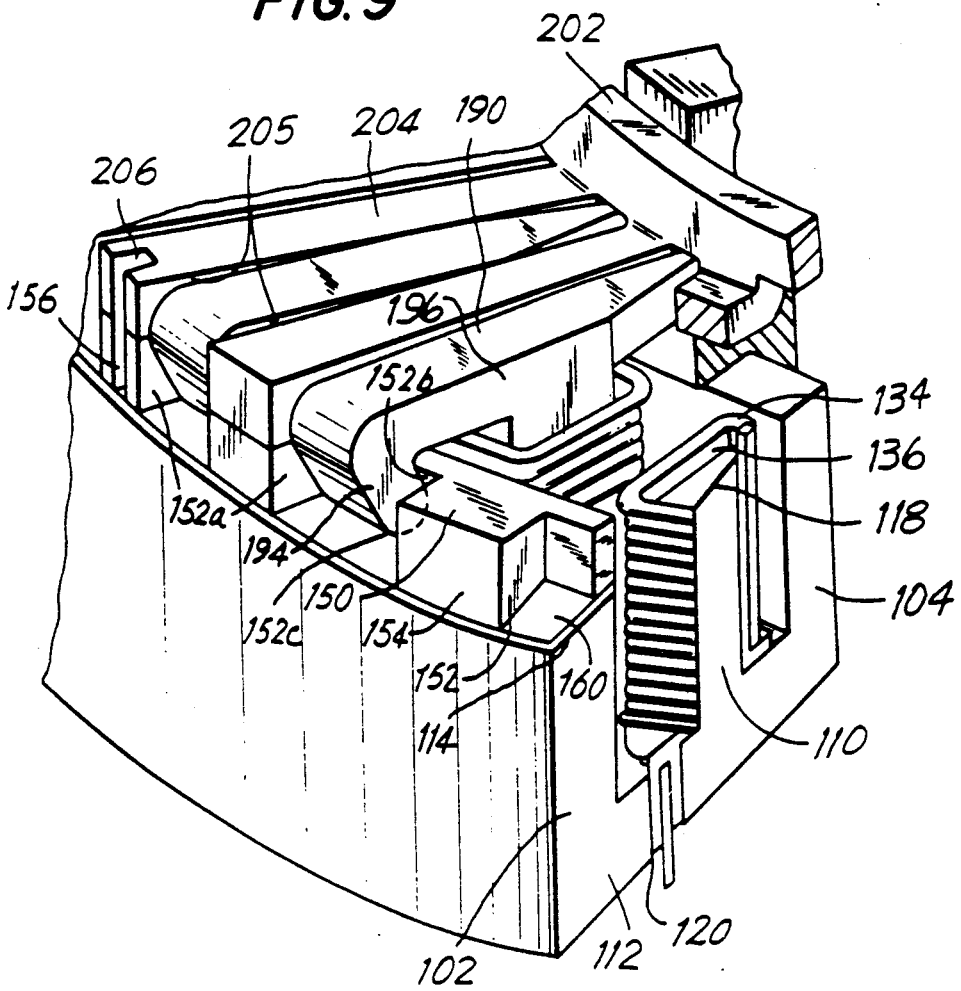

FIG. 13
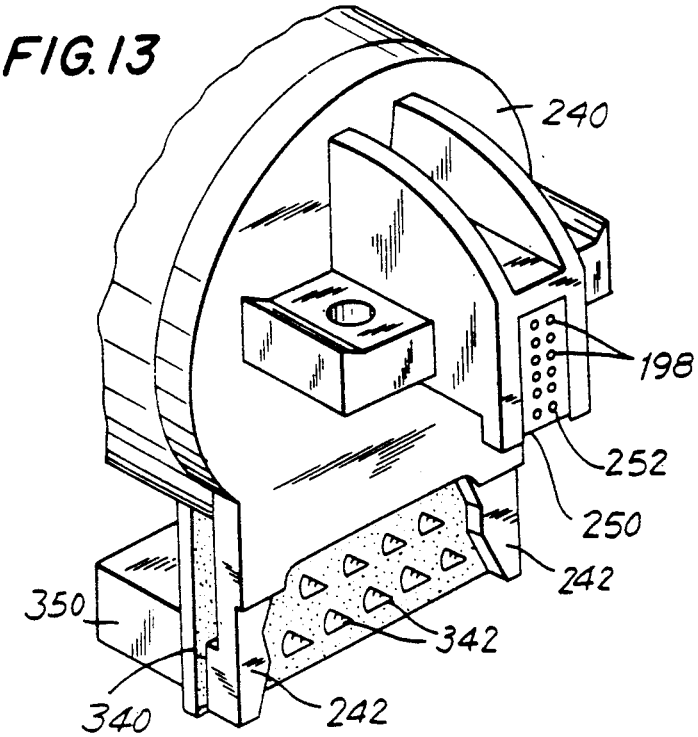
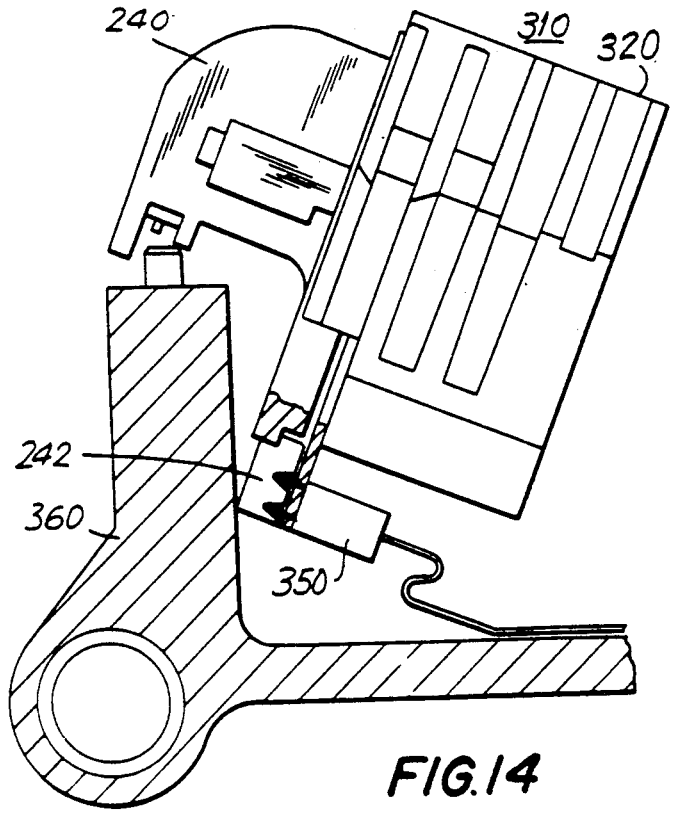
FIG. 14

FIG. 16
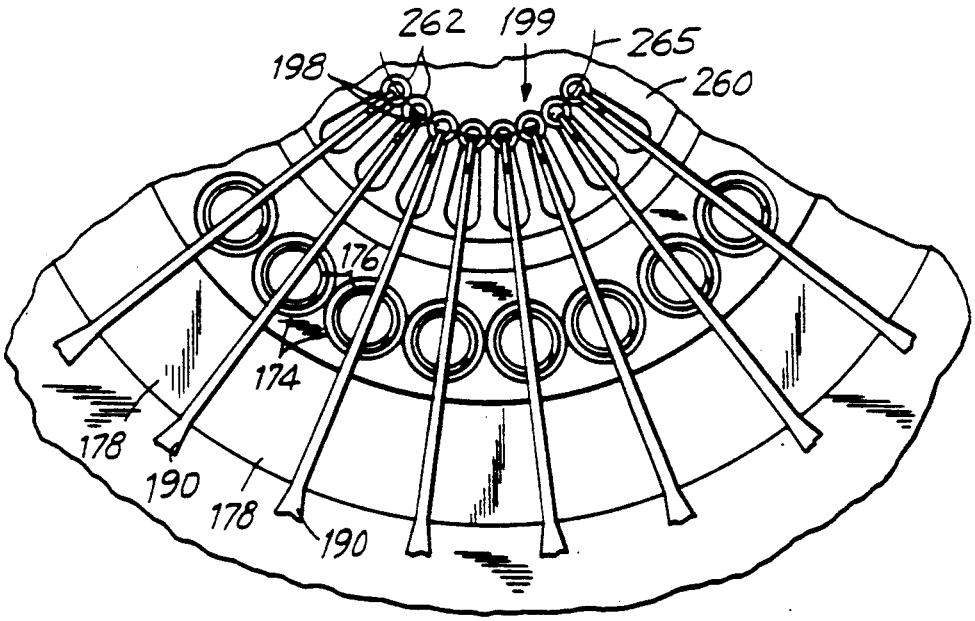
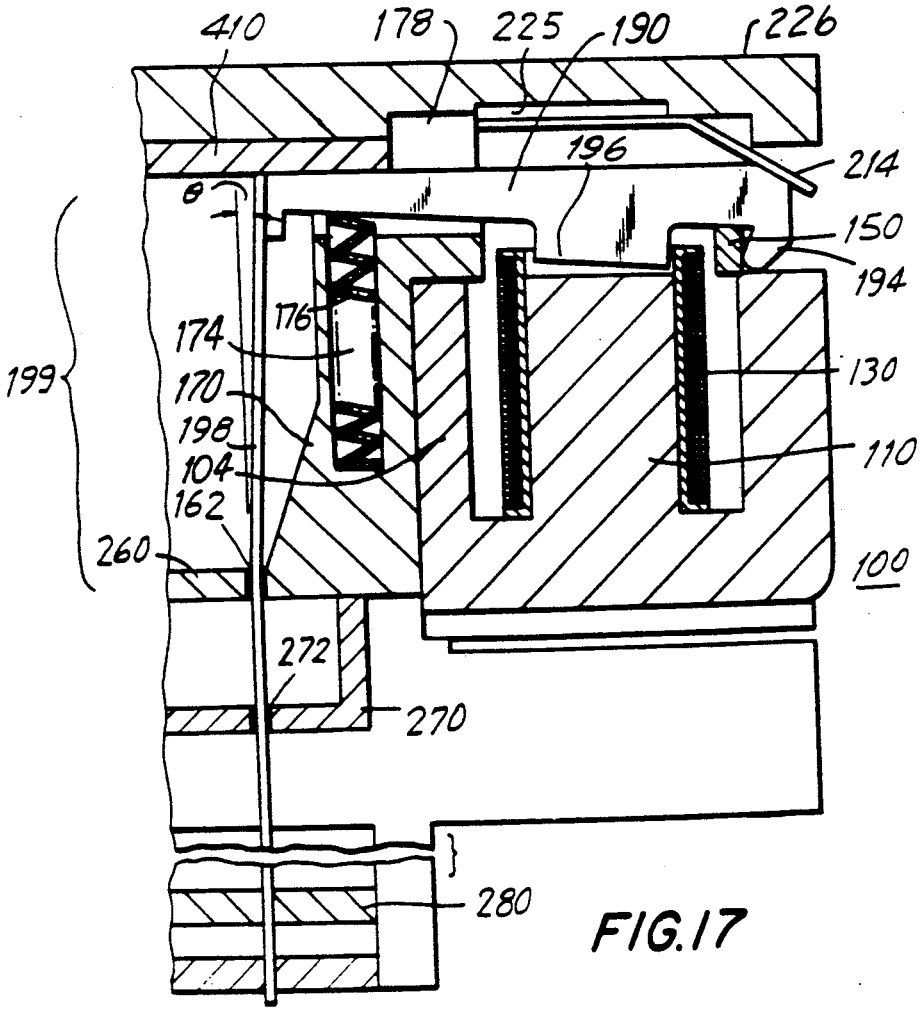
FIG.17

WIRE DOT PRINT HEAD AND METHOD FOR MANUFACTURING SAME

BACKGROUND OF THE INVENTION

The present invention is directed to a wire dot print head, and, in particular, to a wire dot print head having a driving coil for causing a print wire to impact on a platen.

Wire dot print heads are known in the art and fundamentally include a frame. A plurality of print wires mounted on respective levels are positioned within the frame. Drive coils are provided for driving each print wire. To print a pattern, the conventional wire dot print head requires 24 or 48 individual drive coils, levers and print wires to be positioned within the frame. Accordingly, one design problem of the conventional wire dot printer is to balance integration density with ease of assembly.

One such construction for overcoming the above concern is shown in U.S. Pat. No. 4,767,227 which describes a wire dot print head which provides for attaching a dot forming print wire at one end of a lever. The lever which is attracted by a drive coil is then mounted about a rotation shaft. A recess is formed within a yoke for fixing the rotation shaft thereto.

The prior art wire dot print head has proven satisfactory. However, the construction suffers from the inherent problem that the yoke requires a space in which to receive and position the rotating shaft provided on the lever. Hence, the number of units such as the lever which can be positioned in a single plane is limited and therefore integration density cannot be improved. Additionally, because the lever is mounted about a rotating shaft, the number of manufacturing processes increases making the assemblage more complicated resulting in increased cost. Additionally, in the prior art, to increase the number of wires to enhance print quality, it becomes necessary to stack the frame in multi-stage print wire layers. As a result, the overall size of the wire dot print head increases and because there is difference in length between individual print wires in each layer, the wire flex at the time of impact varies giving rise to a difference in print density.

Accordingly, it is desired to provide a wire dot print head in which integration density is increased while maintaining a structure which is easily manufactured.

SUMMARY OF THE INVENTION

Generally speaking, in accordance with the invention, a wire dot print head includes a frame formed of magnetic material having an inner peripheral wall and an outer peripheral wall. A core portion is formed between the inner peripheral wall and the outer peripheral wall so that the top of the core, inner peripheral wall and outer peripheral wall are coplanar. A driving coil is inserted about the core so that its upper end extends above the end surface of the core. A first yoke formed of a magnetic material is disposed on the outer peripheral wall of the frame and has a recess formed therein positioned above the core. A lever is formed with a lever locking portion, a hooked end to form a rotation support member and a central projecting member forming an armature. A print wire is affixed at one end of the lever. The rotation support member of the lever engages the recess of the first yoke to form a center of rotation.

Accordingly, it is an object of the invention to provide an improved wire dot print head.

Another object of the invention is to provide a wire dot print head with improved integration density of print wires while providing a simplified assembly and further reducing manufacturing cost by eliminating a rotation shaft member from the print wire driving lever.

A further object of the invention is to provide a wire dot print head which allows shortening of the reset time by minimizing the moment of inertia once printing is completed.

Yet another object of the invention is to provide a wire dot print head which includes a lever which may be formed through forging and press working.

Still another object of the invention is to provide a wire dot print head which provides uniform maneuverability of the print wires formed in a circular array.

Yet another object of the invention is to provide a wire dot print head which provides positioning structure for the print wires which are capable of positioning each member in a simple structure which may be built in layers.

A further object of invention is to provide a wire dot print head capable of providing a smooth movement within its moving members such as the lever, print wire and the like.

Still another object of the invention is to provide a. wire dot print head with a fixed structure which allows a simple radiator for radiating heat from the print head.

Still another object of the invention is to provide a wire dot print head which is capable of adjusting a stroke volume of the print wires through simple adjustments.

Yet another object of the invention is to provide a manufacturing method for a wire dot print head capable of being manufactured in a simplified process.

Still other objects and advantages of the invention will in part be obvious and will in part be apparent from the specification.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8*a* is a front elevational view of a lever constructed in accordance with the invention;

FIG. 8*b* is a side elevational view of a lever constructed in accordance with the invention;

FIG. 9 is a partial sectional perspective view of a lever set in a frame constructed in accordance with the invention;

FIG. 13 is a partial perspective view of a wire dot print head constructed in accordance with the invention;

FIG. 14 is a side elevational view of a wire dot print head being mounted on a carriage in accordance with the invention;

FIG. 16 is a partial top plan view of an array of print levers constructed in accordance with the invention;

FIG. 17 is a sectional view indicating the flex of the print wire when moved in accordance with the invention;

DESCRIPTION OF THE PREFERRED EMBODIMENTS

Figure 26:
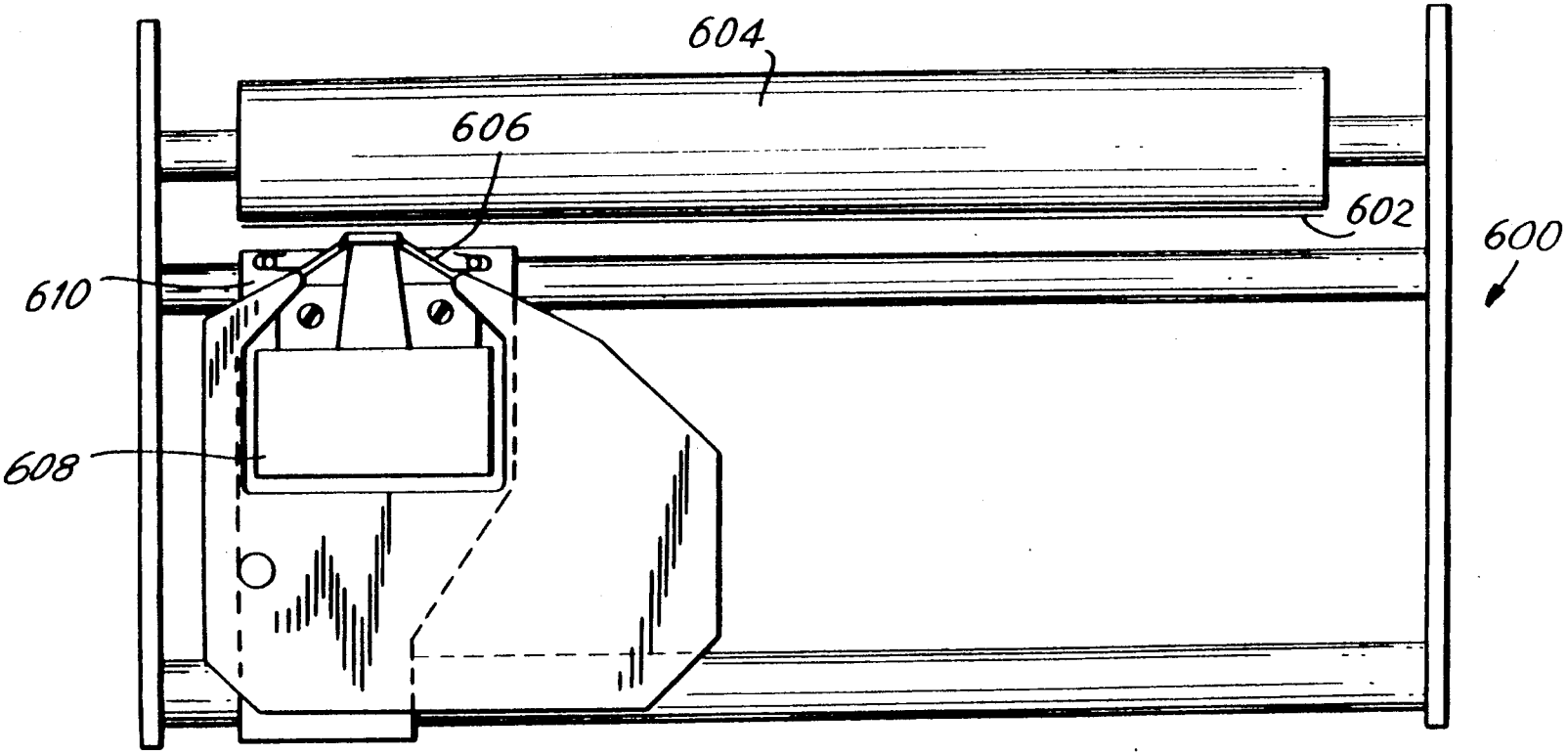
FIG. 26 is a top plan view of a printer used in connection with the dot wire print head constructed in accordance with the invention.

Reference is first made to FIG. 26 in which a printer, generally indicated as 600, used in conjunction a wire dot print head, generally indicated as 608, constructed in accordance with the invention, is provided. A platen 604 is rotatably supported within printer 600. A carriage 610 is supported within printer 600 and travels in the direction of print columns along platen 604. Wire dot print head 608 is mounted on carriage 610 and moves therewith. The desired patterns, characters and the like are printed on paper 602 positioned between platen 604 and an ink ribbon 606 by wire dot print head 608.

Figure 1:
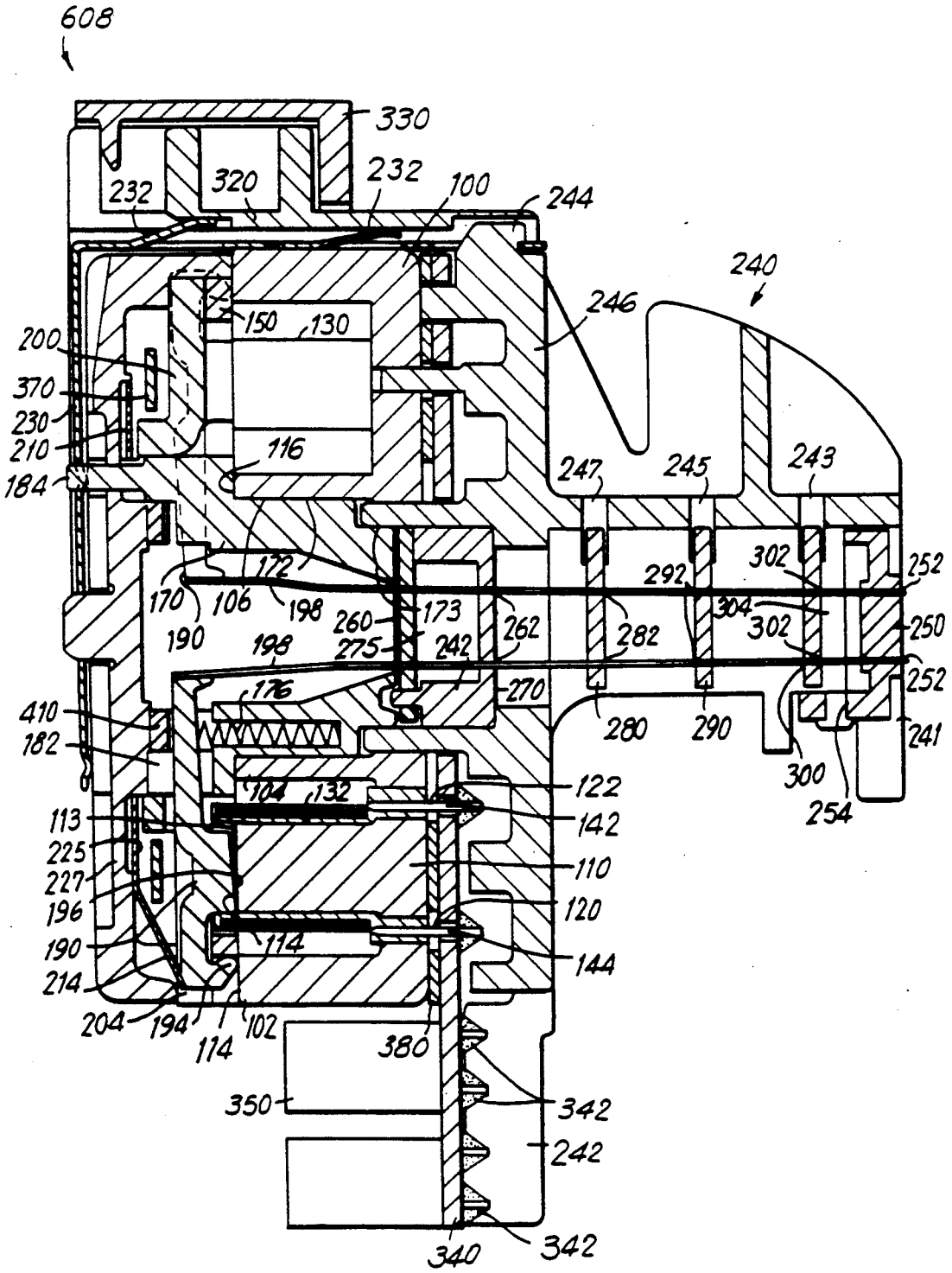
FIG. 1 is a sectional view taken along line 1—1 of FIG. 11 representing a wire dot print head constructed in accordance with the invention.
Figure 2:
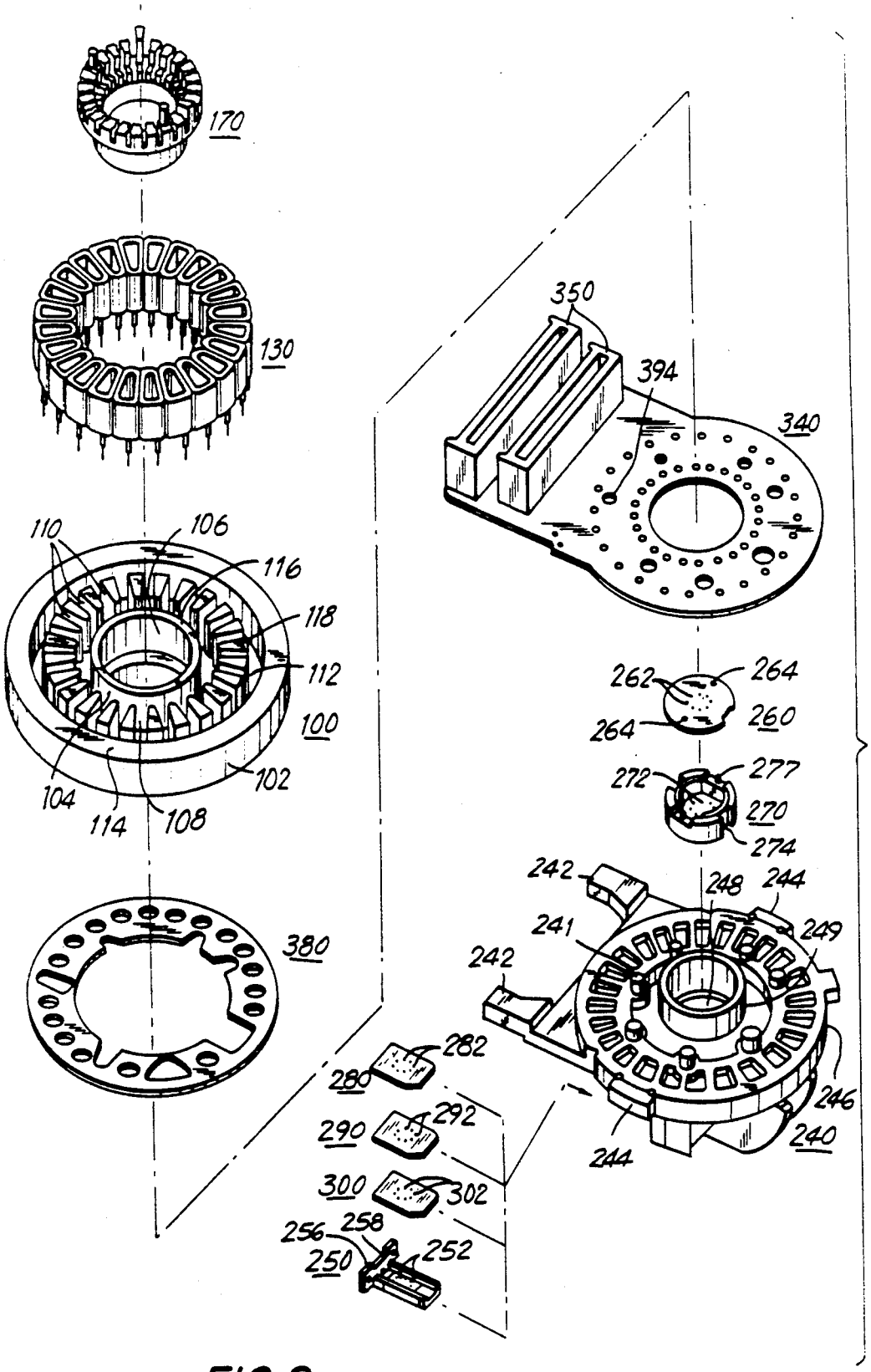
FIG. 2 is an exploded perspective view of a portion of the wire dot print head depicted in FIG. 1 constructed in accordance with the invention.
Figure 3:
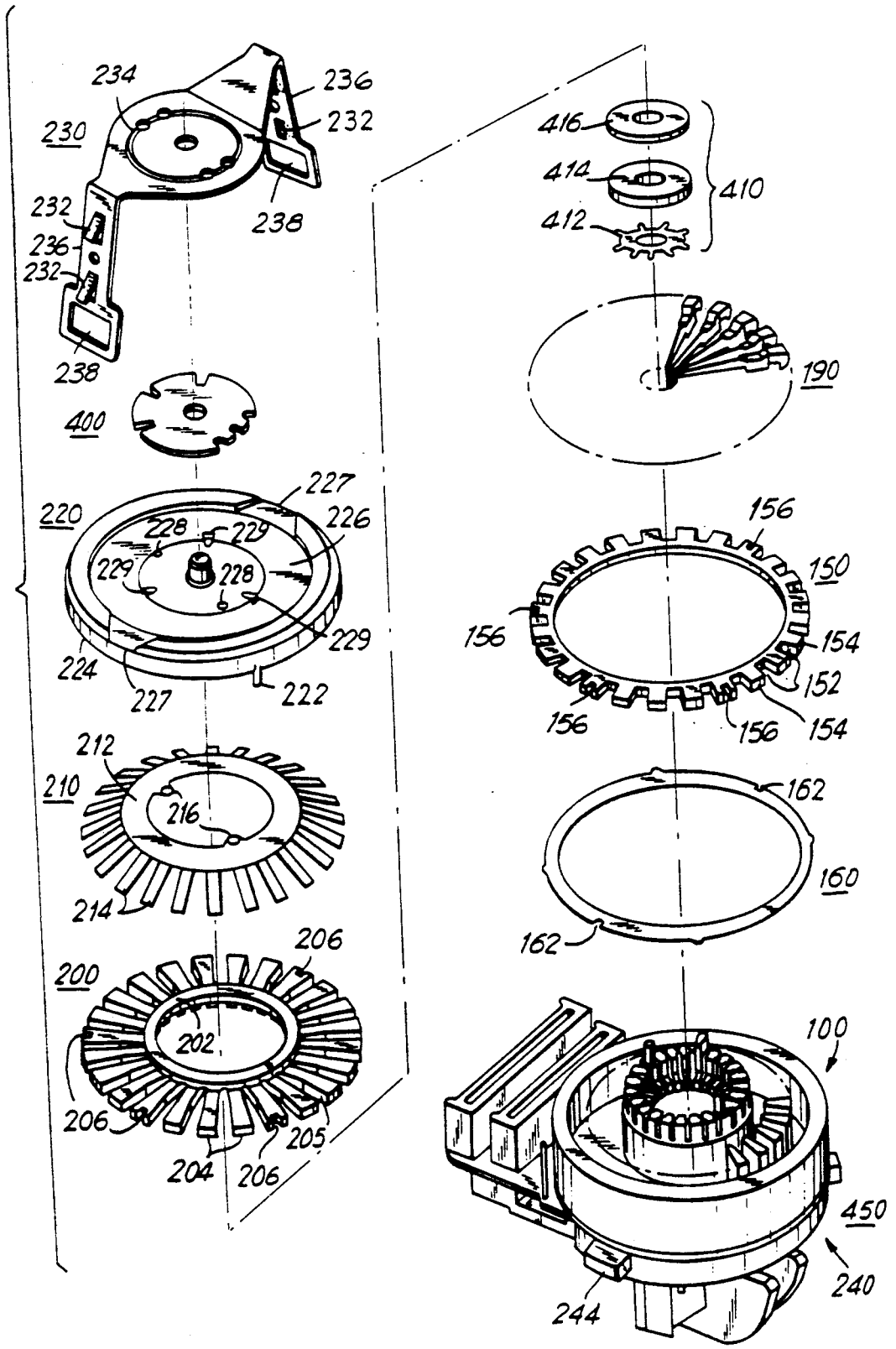
FIG. 3 is an exploded perspective view of a portion of the wire dot print head depicted in FIG. 1 constructed in accordance with the invention.

Reference is now made to FIGS. 1–3 wherein a more detailed representation of print head 608 is provided. Print head 608 includes a frame 100 and supports a circuit substrate 340 which connects print head 608 to an external device. A coil 130 wrapped about a portion of frame 100 which constitutes a portion of a magnetic circuit is supported on circuit substrate 340. A lever 190 rotatably supported on frame 100 is formed of a magnetic material. Lever 190 has one outer side formed as a hook to act as a rotation support member 194, and a central projecting portion to form an armature member 196. A print wire 198 is fixed at one end of print lever 190. Lever 190 is also supported by a first yoke 150 and a second yoke 200. A supporting retainer spring 210 resiliently presses an outer end portion of lever 190 at all times towards a corner of an outer peripheral wall 102 of frame 100 and a recess 152 formed within first yoke 150. A lever holder 220 presses supporting retainer spring 210 and functions as a part of the outer case of print head 608. A nose 240 for guiding print wire 198 is positioned at the front of print head 608. A fixed spring 230 affixes lever holder 220 on nose 240.

Figure 4:
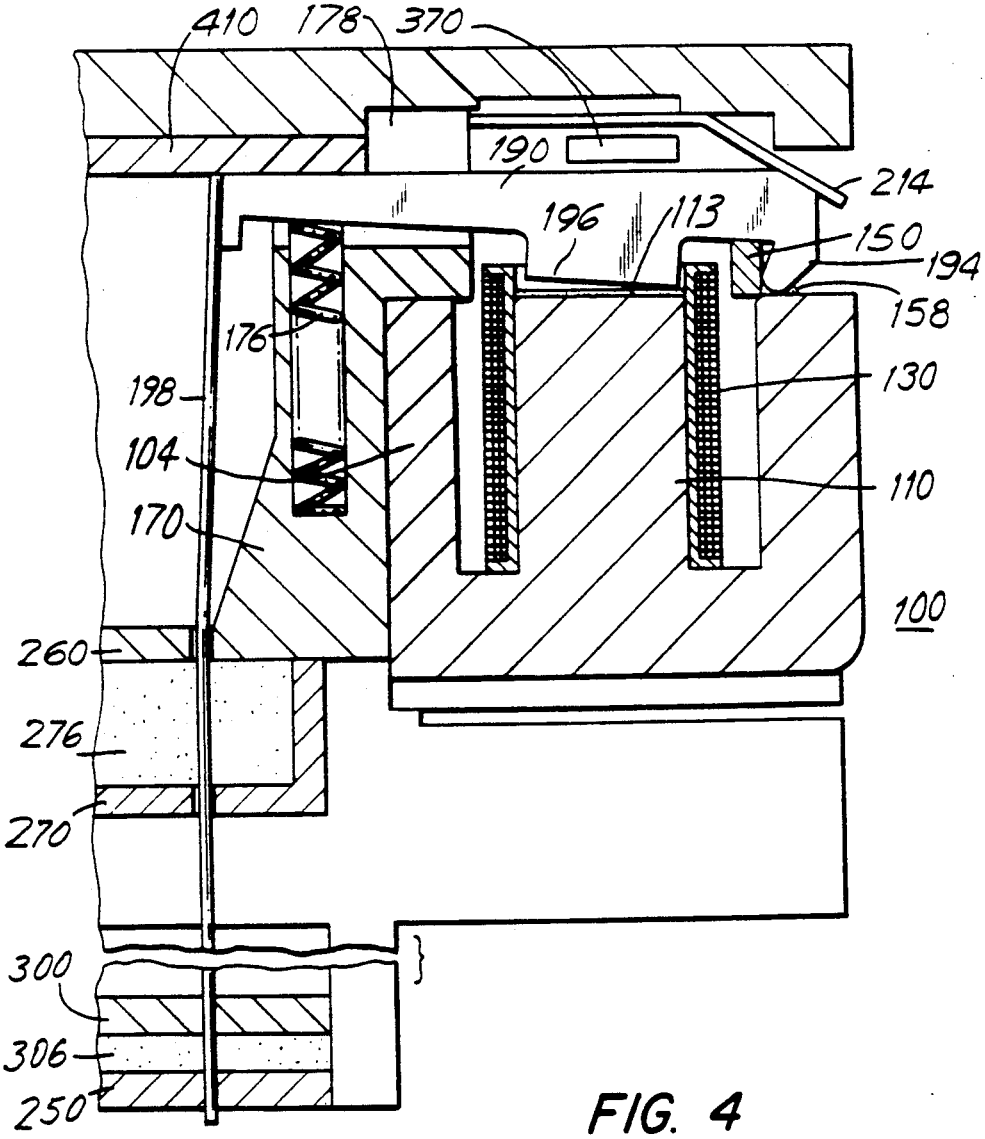
FIG. 4 is a partial sectional view of the wire dot print head of FIG. 1 indicating the portions in which a lubricant is to be added to the wire dot print head in accordance with the invention.

As seen in FIG. 2, frame 100 is formed from a magnetic material in a ringed cup shape having an outer peripheral wall 102 and inner peripheral wall 104. Nose 240 is partitioned by inner wall 104 and a through hole 106 provided at the central portion of frame 100 for encircling a spring holder 170 therein. Outer peripheral wall 102 is separated by a space 108 from inner peripheral wall 104. A plurality of cores 110 extend diametrically within space 108 at regular intervals about the circumference of frame 100. In an exemplary embodiment, twenty four (24) cores 110 are formed. Outer peripheral wall 102, inner peripheral wall 104 and core 110 are trimmed at a constant coplanar height so as to have respective end surfaces 114, 116, 118 within the same plane enabling them to function as a reference plane for other members which are built up upon frame 100. Lever 190 contacts an end surface 118 of core 110. A lubricant 113, as shown in FIG. 4, is applied to end surface 118 of each core 110 thereby decreasing friction and wear when contacting with armature member 196 of lever 190.

Figure 6:
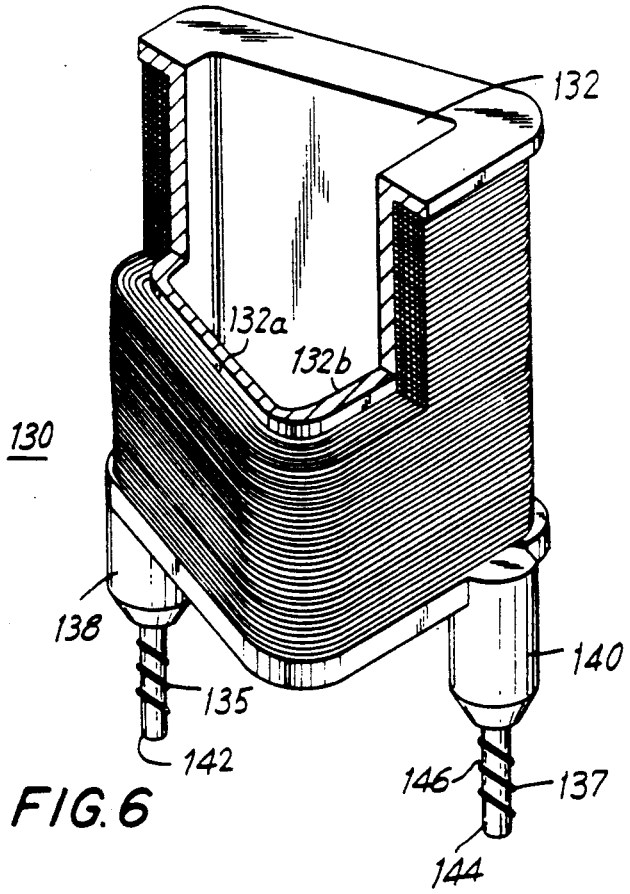
FIG. 6 is partial sectional perspective view of a drive coil constructed in accordance with the invention.

Frame 100 is formed with a bottom portion 112 having holes 120, 122 extending there through. A bobbin 132 is inserted within holes 120,122 and is positioned about respective core 110. Coil 130 is wound about bobbin 132. As seen in FIG. 6, where an example of a coil 130 is provided, bobbin 132 is formed of an electric insulating material such as a macro molecular material or the like in a shape which is insertable onto core 110 of frame 100. Bobbin 132 is dimensioned to extend above the end surface 118 of core part 110 when enclosed about core part 110 forming a space 136 above end surface 118 as shown in FIG. 9. Armature member 196 of lever 190 is positioned within space 136.

Bobbin 132 is provided with two cylindrical legs 138, 140 which extend from the bottom thereof into respective terminals 142, 144 which project through holes 120, 122 of frame bottom 112. Once terminals 142, 144 are extended through holes 120, 122 they are soldered to a circuit substrate. Coil 130 is wound about bobbin 132 from a beginning 135 connected to terminal 142 through an end 137 connected to terminal 144. Coil bobbin 132 has a circumferential wall 132*a* which is formed thinner than a radial wall 132*b*. A multiple number of coils can be efficiently wrapped about the circumference. The thinner wall 132*a* becomes, the more space efficiency increases. Coil bobbin 132 may also be formed having a portion of wall 132*a* hollowed out as a window.

As seen in FIG. 3, yoke 150 may be formed as a ring shaped magnetic material provided with salients 154 projecting from the ring towards the outer periphery. Salients 154 are provided at regular intervals separated by recess 152 positioned opposite each core 110. Yoke 150 is positioned on a top of, i.e. end surface 114 of the outer peripheral wall 102 of frame 100 through a ring plate 160 formed with a wear resistant material. As seen in FIG. 4, a lubricant 158 is applied to the surface of recesses 152 and ring plate 160 to make the movement of lever 190 smoother while decreasing wear on the moving parts.

Wear resistant material is normally in low magnetic permeability. Therefore, an increase in magnetic resistance may result from the insertion of such material. However, ring plate 160 used in the invention is extremely thin having a thickness no greater than 30 to 160 μm so that an increase in magnetic resistance or a magnetic saturation would never be substantially caused by ring plate 160.

Figure 7:
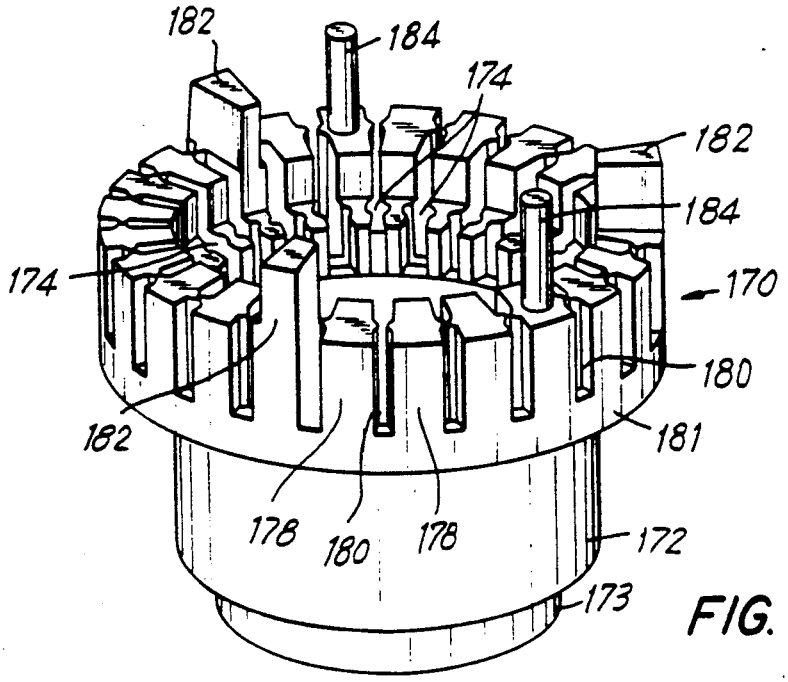
FIG. 7 is a perspective view of a spring holder constructed in accordance with the invention.
Figure 24:
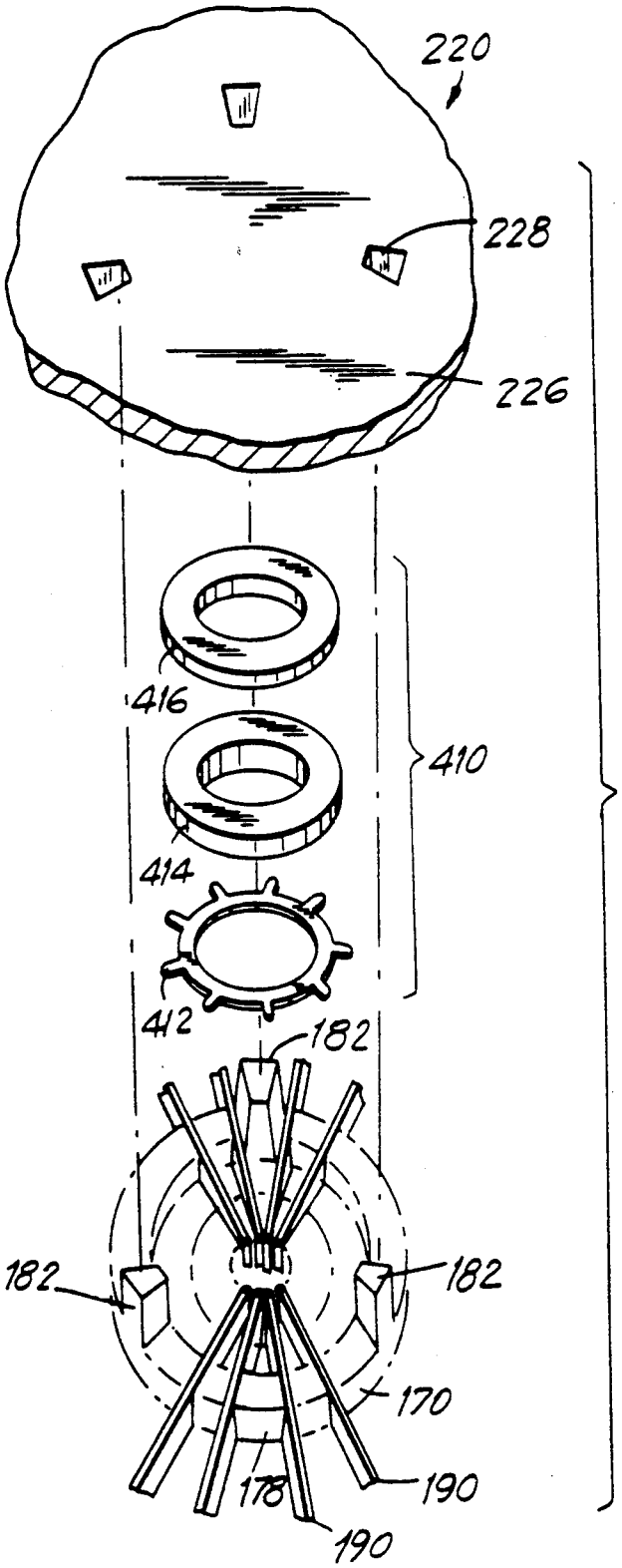
FIG. 24 is an exploded view illustrating a method for constructing the damper element in accordance with the invention.

Reference is now made to FIG. 7 in which a spring holder, generally indicated as 170, is shown. Spring holder 170 includes a body 172 which is inserted within through hole 106 of frame 100. A salient 173 positions a rear end guide plate 260 at the bottom portion of spring holder 170. A spring retaining hole 174 is provided within spring holder 170 positioned above core 110. A reset spring 176 for pushing lever 190 towards a damper member 410 is contained within hole 174. Salients 178 are provided in the upper portion of spring holder 170 on an outer periphery of spring enclosing hole 174. A guide groove 180 for guiding a top end of lever 190 is formed in the upper portion of spring holder 170. A plurality, three in this embodiment, of salients 178 are extended farther beyond the top edges of the remaining salients 178 to function as a guide piece 182 for damper member 410 (FIG. 24).

As seen in FIGS. 8*a* and 8*b*, lever 190 has one end formed as a hook to act as rotation support member 194. A circular portion 194 is formed on the hook end. A central portion forming an armature member 196 projects outward and is positioned opposite core 110. Printing wire 198 is fixed at an end of lever 190 which is opposite to support member 194. Rotation support member 194 has an inner angle Ω formed as an acute angle. Inner surface 192 formed by angle Ω comes in contact with and is stopped by three wall surfaces 152*a*, 152*b*, 152*c* forming recess 152 within first yoke 150 as well as wear resisting plate 160 (FIG. 9). A print wire bearing end 197 of lever 190 is fitted within groove 180 of spring holder 170 and comes in contact with reset spring 176 and is resiliently pressed in one direction by spring 176 and in the opposite direction by damper member 410.

Figure 10:
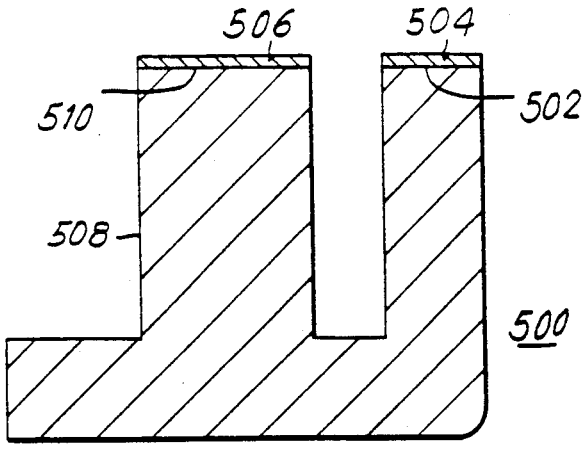
FIG. 10 is a sectional view of a core constructed in accordance with a second embodiment of the invention.

In an exemplary embodiment as shown in FIG. 9, rotation support member 194 of lever 190 is stopped by wear resisting ring plate 160. However, as shown in FIG. 10 a wear resisting layer 504, made of a wear resistant metal or the like, may be formed directly on outer peripheral wall end surface 502 of frame 500. Accordingly, no wear resisting ring plate need be interposed between lever 190 and the frame. Furthermore, a similar wear resisting layer 506 may be formed on an end surface 510 of a core 508. The wear resisting layer 506 decreases wear arising at the core 508 when armature member 196 comes in contact therewith.

Second yoke 200 is formed of daisy shaped magnetic material having an inner ring 202. Inner ring 202 is dimensioned to fit on an outer periphery of spring holder 170. Branches 204 extend radially at spaced intervals from ring 202. Ring 202 is formed so as not to prevent movement of lever 190 and thus is fitted on an outer peripheral wall portion 181 of spring holder 170. Branches 204 are disposed at regular intervals at angles coinciding with salient 154 of first yoke 150 and second yoke 200 is placed on first yoke 150. By placing second yoke 200 on first yoke 150, lever 190 will be guided between side walls 205 of branches 204.

As seen in FIG. 9, lever 190 is guided in a lateral direction by side walls 205 of branches 204 as well as side walls 152*a*, 152*c* of first yoke 150. The smaller the gap between lever 190 and each of the side walls, the higher the magnetic efficiency becomes. However, when the relative position between the first yoke and the second yoke is not properly aligned, it becomes impossible to provide lever 190 within the gaps formed between the walls. Therefore, to prevent this problem from occurring, the gap between the first yoke or the second yoke and lever 190 may be enlarged.

In this embodiment, ring 202 is formed on an inner periphery of the branches 204. However, it is apparent that a similar operational effect may be obtained by forming ring 202 on the outer periphery of branches 204.

As seen in FIG. 3, supporting retainer spring 210 includes a ring 212 having a plurality of branches 214 extending radially therefrom at an acute angle relative to ring 212 at spaced intervals. Supporting retainer spring 210 contacts an upper end of rotation support member 194 of lever 190 pressing circular portion 192 of rotation support member 194 to a wall surface of recess 152 of first yoke 150 and wear resisting ring plate 160 (wear resisting layer 504 of outer peripheral end surface 502 in frame 500).

Lever holder 220 is formed from resilient materials such as a macro molecular material or the like in a cup like form. Lever holder 220 includes a peripheral wall 224 which contacts second yoke 200. Lever holder 220 also includes cover plate 226 formed within peripheral wall 224 which contacts ring 212 of supporting retainer spring 210. Lever holder 220 is resiliently fixed to a projection 244 of nose 240 by a fixed spring 230 operating on a central portion of lever holder 220 through a reinforcing plate 400 intermediately disposed therebetween. Thus, lever holder 220 is deflected to come in contact with salients 178 of spring holder 170 and is perpendicularly positioned. With this construction, a holding position of lever 190 is dependent on a position of damper member 410, as it cooperates with lever holder 220. Therefore, as seen in FIGS. 1 and 24, the position in which printing lever 190 is held can be maintained accurately, minimizing a dispersion of the lever stroke.

By providing such construction, in which lever 190 has a rotation support member 194 maintained by supporting retainer spring 210, against recess 152 of first yoke 150 and Wear resisting ring plate 160 to form a center of rotation at that point, a special rotating shaft member is no longer required. Accordingly, lever 190 may be have its thickness w (FIG. 8*a*) reduced increasing the number of levers 190 arrayed about frame 100 increasing the integration density. Furthermore, because a rotating shaft member is no longer required for lever 190, lever 190 may no be manufactured utilizing only the process of forging and press working, reducing the cost of production.

Nose 240 is formed with a cylindrical part which fits within through hole 106 of frame 100. A pedestal 246 contacts a bottom portion 112 of frame 100 through electric insulating plate 380 disposed therebetween. Two legs 242 project from pedestal 246 as seen in FIG. 13. Legs 242 are formed to be thicker than the height of a soldered portion 342 when a connector 350 for connecting print head 608 to a host is soldered on circuit substrate 340.

Nose 240 includes guides for guiding wire 198 through nose 240. Nose guide plate 250 contains a plurality of guide holes 252 for aligning print wires 198 as disposed at one end of nose 240. A rear end guide plate 260 which contains a plurality of guide holes 262 formed in a circular pattern in accordance with an array of levers 190 is disposed within nose 240 at an end closest to lever 190. A cuplike guide member 270 having guide holes 272 formed therein is positioned intermediate guide plate 250 and guide plate 260. A first guide plate 280 having guide holes 282 formed therein is positioned within a groove 247, a second guide plate 290 having guide holes 292 formed therein is positioned within a groove 245 and a third guide plate 300 having guide holes 302 therein is positioned in a groove 243. Guide holes 272, 282, 292 and 302 are positioned so as to intersect a straight line by which guide hole 252 of nose guide plate 250 and guide hole 262 of rear end guide plate 260 are connected. Accordingly, guide holes 252, 262, 272, 282, 292 of nose guide plate 250 intermediate guide plates 270, 280, 290, 300 and rear end guide plate 260 are all positioned in a substantially straight line for guiding print wire 198.

As can be seen in FIG. 4, lubricants 276 such as grease or the like are provide in the space 275 formed by a cuplike guide member 270 and rear end guide plate 260. Lubricants 306 are also provide in space 304 formed between nose guide plate 250 and guide plate 300. These lubricants insure that friction between print wire 198 and the respective guide holes is minimized allowing the smooth movement of print wire 198.

Figure 11:
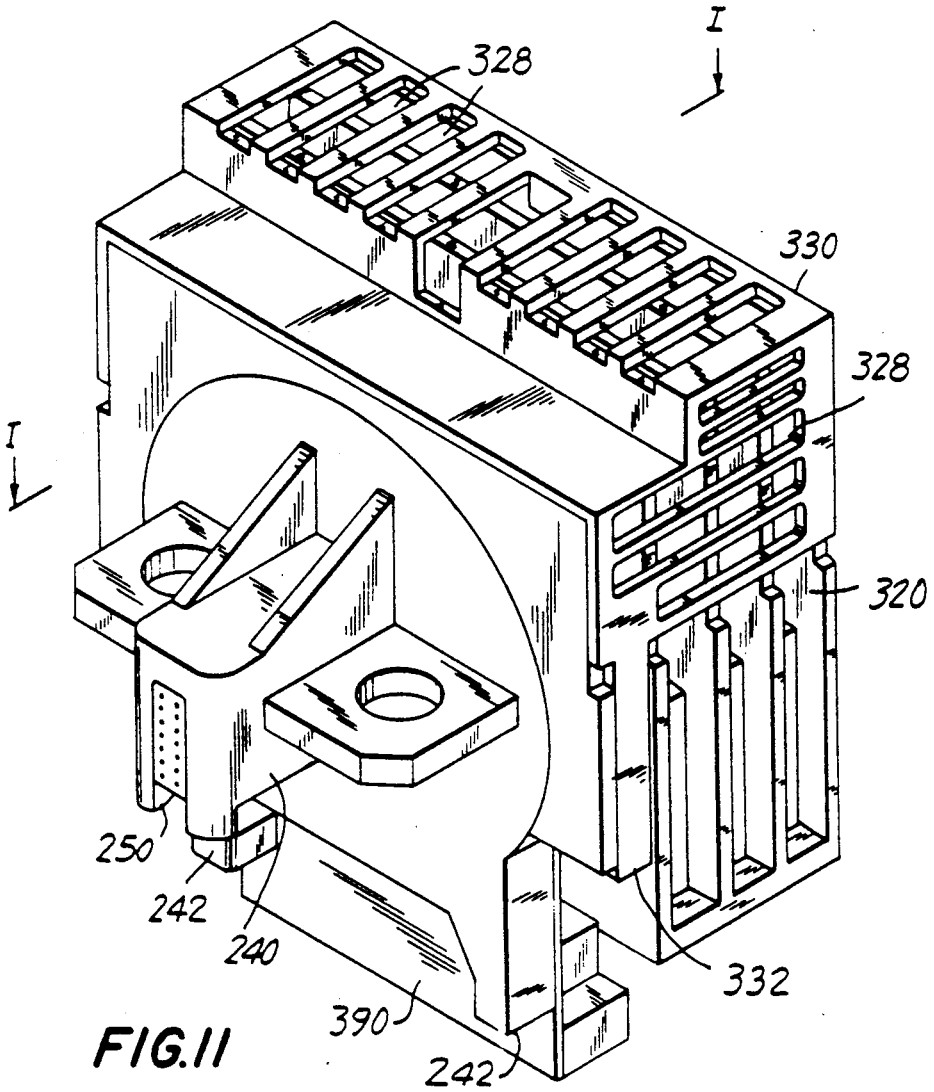
FIG. 11 is perspective view of a dot wire print head constructed in accordance with the invention.
Figure 12:
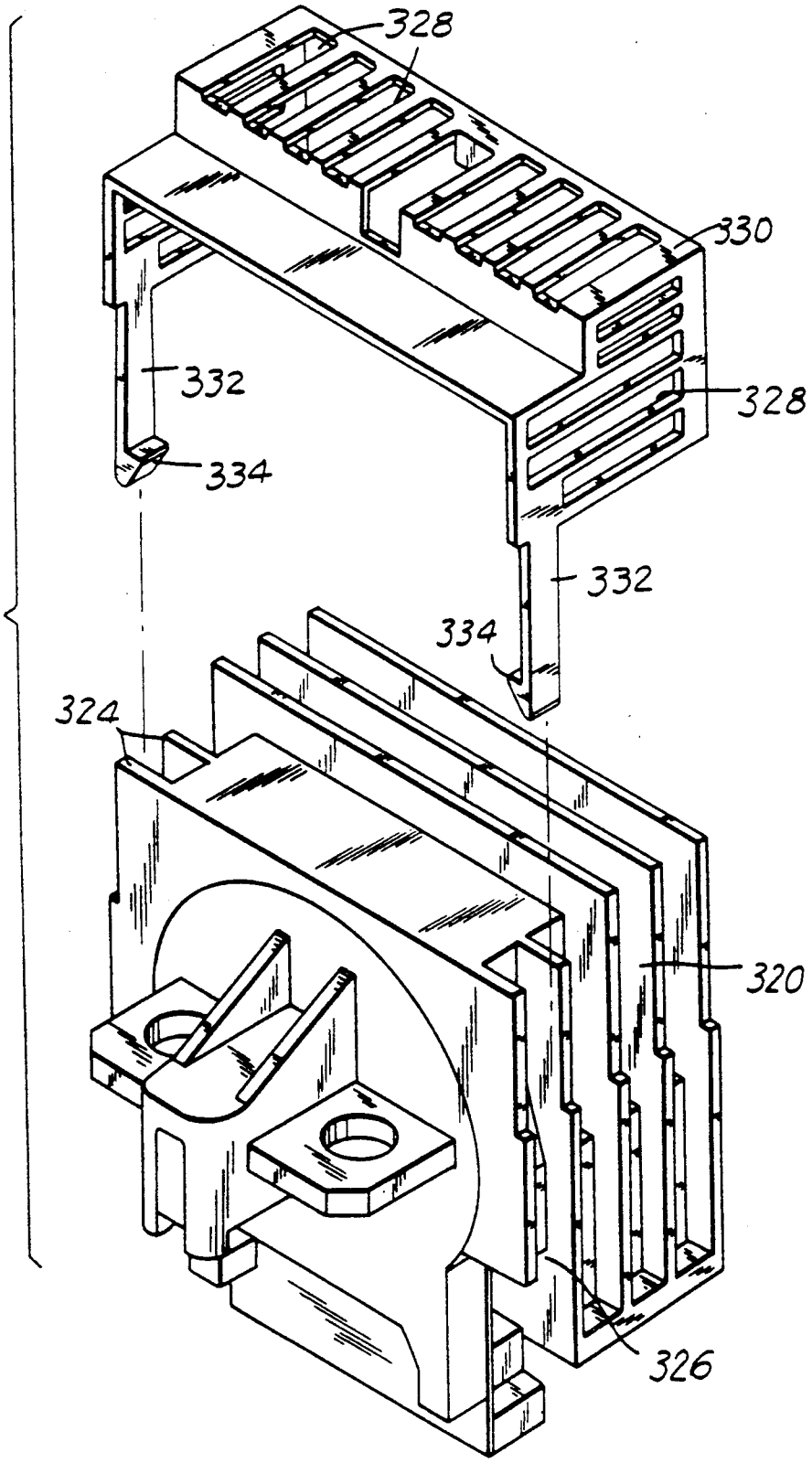
FIG. 12 is an exploded view of a dot wire print head with guard cover constructed in accordance with the invention.

As seen in FIGS. 11 and 14, a print wire driving device 310 is provided with a heat sink member 320 installed about the periphery of print wire driving device 310 to radiate the joulean heat generated by coil 130. A reed 232 projects externally of fixed spring 230. Heat sink member 320 locks reed 232 of fixed spring 230 and electrically contacts reed 232 to provide an electric conducting path around a heat sink member 320 through fixed spring 230. Additionally, when heat sink member 320 is installed on a member of printer 600, such as carriage 360, which will be touched by the printer user heat sink member 320 is provided with a guard cover 330 made of poor thermal conductor such as plastic or the like to act as a working top. As seen in FIG. 12, guard cover 330 is formed with a plurality of air vents 328 therein. Two legs 332 extend from either side of guard cover 330 to catch a side portion of heat sink member 320 through locking claw 334 formed at a locking end of each leg 332. By inserting legs 332 between fins 324 provided on head sink member 320, locking claw 334 engages with a salient 326 to lock the cover thereon.

Printing wire driving device 310 is connected to an external driving circuit (not shown) by connector 350 of circuit substrate 340 which is then fixed on carriage 360. However, since a forked leg member 242 provide on nose 240 is formed thicker than the soldered portion 342 of circuit substrate 340, circuit substrate 340 is protected by leg member 242 of nose 240 and therefore will never cause a short circuiting of the carriage 610 which is made of a metallic material.

Figure 15A:
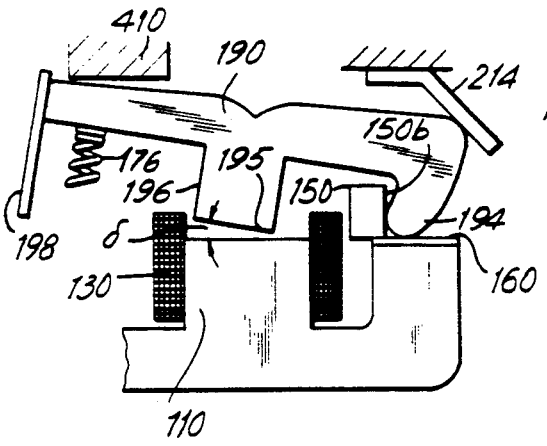
FIGS. 15*a*–15*d* are schematic views showing a time sequence operation of the wire dot print head in accordance with the invention.

Reference is now made to FIGS. 15*a*–15*d* wherein the operation of wire dot print head 608 is provided. As seen in FIG. 15*a*, lever 190 is biased by spring 176 to pivot about pivot member 194 and pressed against damper member 410 when no current is provided through coil 130. The pivot end of lever 190 is pushed in place by a branch 214 of supporting retainer spring 210. Rotation support member 194 is retained in place against vertical wall 152*b* the inner wall surface of recess 152 of first yoke 150 as well as wear resisting ring plate 160. Accordingly, in this position armature member 196 will rise above core 110 by an gap $\delta$ formed between armature member 196 and end surface 118 of core 110.

Figure 15B:
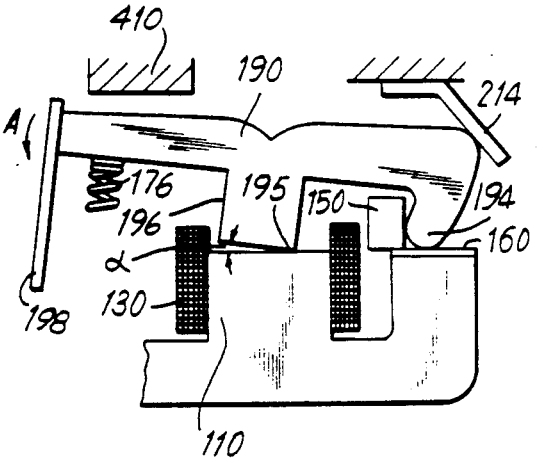

As seen in FIG. 15*b*, when an excitement current is provided to coil 130, a magnetic attraction between core 110 and lever 190 is provided. Lever 190 moves in the direction of arrow A against the force of reset spring 176 towards core 110. Lever 190 pivots around rotation support member 194 which is still pushed against recess 152 of first yoke 150 and wear resisting spring plate 160 by branch 214 of supporting retainer spring 210.

As illustrated in FIG. 16, because print wires 198 are each guided by guide holes 262 formed in a circle 265 of rear end guide plate 260 during this operation, a domain 199 of print wires 198 will shift by an angle $\theta$ (FIG. 17) along the path between guide hole 262 of guide plate 260 and lever 190. Accordingly, a reaction force arising from the deformation of print wire 198 as it moves through print head 608 will be the same for each lever 190 so that all levers 190 will behave with the same kinetic characteristic in accordance with the magnetic attraction forces provides by coil 130. Studies by the inventors have shown that if the travel route from rear end guide plate 260 to nose guide plate 250 is linear, then the kinetic characteristic of the print wire is almost constant irrespective of the route angle.

Figure 15C:
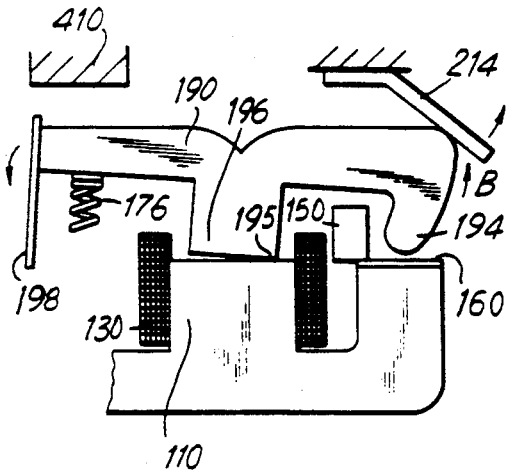

During the shifting of print wire 198, print wire 198 strikes paper 602 through ink ribbon 606 to form a dot on the surface of paper 602. The gap between the tip of print wire 198 and platen 604 is set long enough for lever 198 to leave a separation angle o between end surface 118 of core 110 and armature member 196 at the time of impact. This prevents the magnetic flux density from unnecessarily increasing. If the gap between the tip of wire 198 and platen 604 is longer than a preset value when the exciting current is stopped during this stage, lever 190 further shifts due to inertia bringing armature member 196 into contact with core 110 and rotates about the contact point in the direction of arrow B, namely, a rear end corner 195 of armature member 196 as shown in FIG. 15*c*.

Figure 15D:
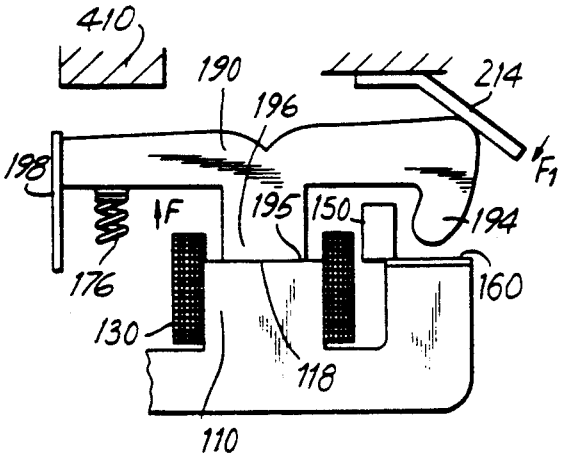

Simultaneously, as rotation support member 194 begins to rotate upwards against the resilience of retainer spring 210 in the direction of arrow B and the end surface of armature member 196 contacts end surface 118 of core 110, lever 190 comes to a stop as shown in FIG. 15*d*.

At this moment of operation, lever 190 receives reaction force shown by arrow F stored in reset spring 176 and a reaction force $F_1$ of supporting retainer spring 210 to return lever 190 to its original position as shown in FIG. 15*a*. However, since armature member 196 comes in contact with core 110 to pivot lever 190 about the contact point at the point which is closest the core 110, a moment of inertia of lever 190 is minimized, allowing a high speed shift upon the causing of reaction force $F_1$ of supporting retainer spring 210. This causes lever 190 to contact damper member 14 stopping lever 190 in the original position.

According to tests conducted by the inventors, a moment of inertia relative to end portion 195 as a supporting point along armature 196 was reduced 20 to 50% when compared with the moment of inertia for rotation about rotation support member 194. Additionally, a reset time of lever 190 was shortened by 20 to 50% when compared with the prior art. Thus, high speed drive near print wire 190 is realized.

Figure 18A:
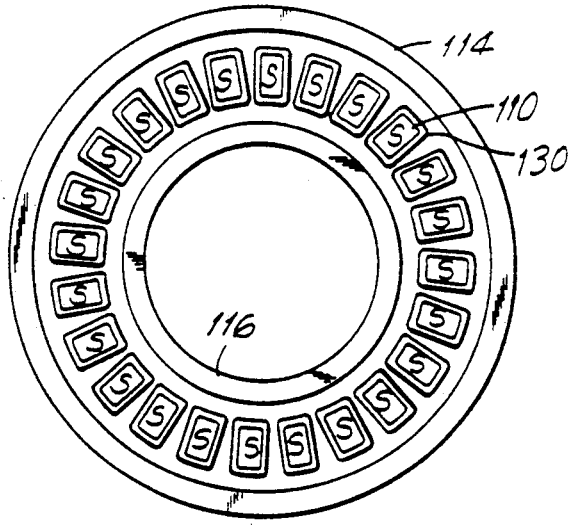
FIG. 18*a* illustrates a driving coil pattern in connection with a driving method of one embodiment of the invention.
Figure 18B:
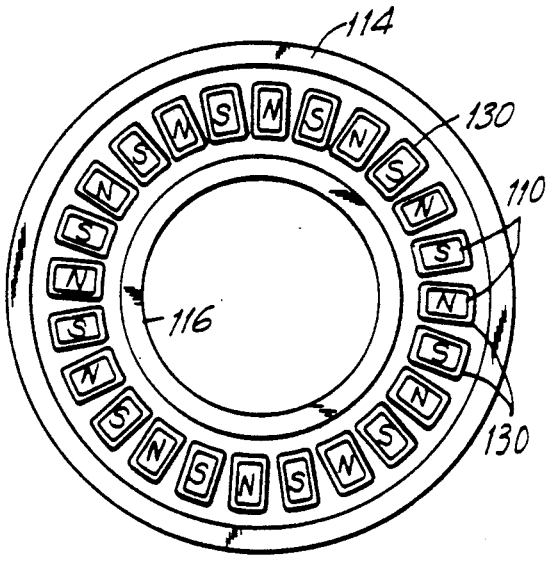
FIG. 18*b* illustrates a driving coil pattern in connection with a driving method of a second embodiment of the invention.
Figure 18C:
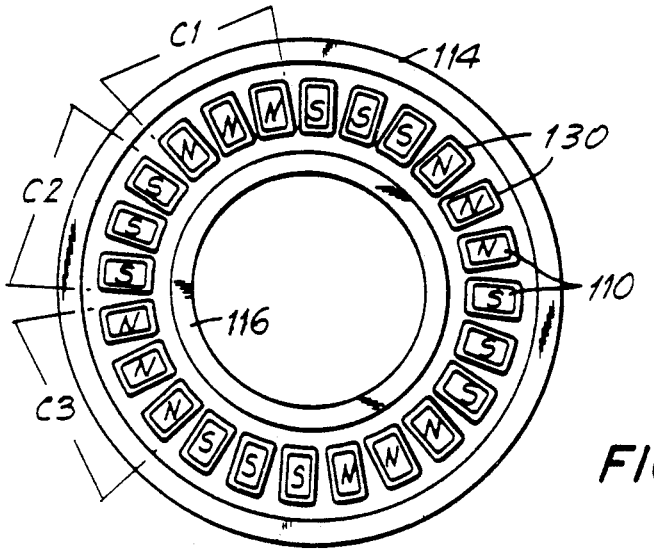
FIG. 18*c* illustrates a driving coil pattern in connection with a driving method of a third embodiment of the invention.
Figure 19A:
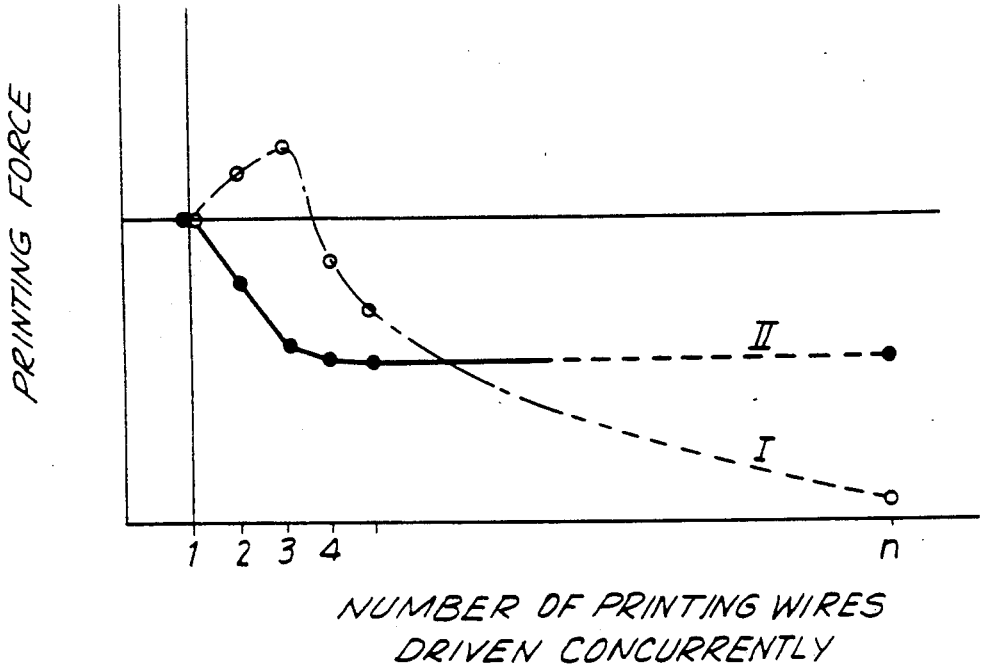
FIGS. 19*a* and 19*b* are graphical representations of the relationship between the number of print wires driven concurrently and a print force when driven in accordance with the driving methods of FIG. 18*a*–18*c*.

In the print wire drive device constructed in accordance with the invention, lever 190 is attracted to core 110 of frame 100 through the excitation of coils 130. As shown in FIG. 18*a*, coils 130 may be excited to the same polarity or to alternative inverse polarities as shown in FIG. 18*b*. However, with these driving methods, printing force deteriorates as shown in FIG. 19*a* as the number of print wires to be driven concurrently increases. In FIG. 19*a*, I denotes a printing force of the wire when driven by the method utilizing the polarization pattern of FIG. 18*a* and II denotes the printing force of print wire 198 and driven with a method utilizing the polarization pattern of FIG. 18*b*.

Figure 19B:
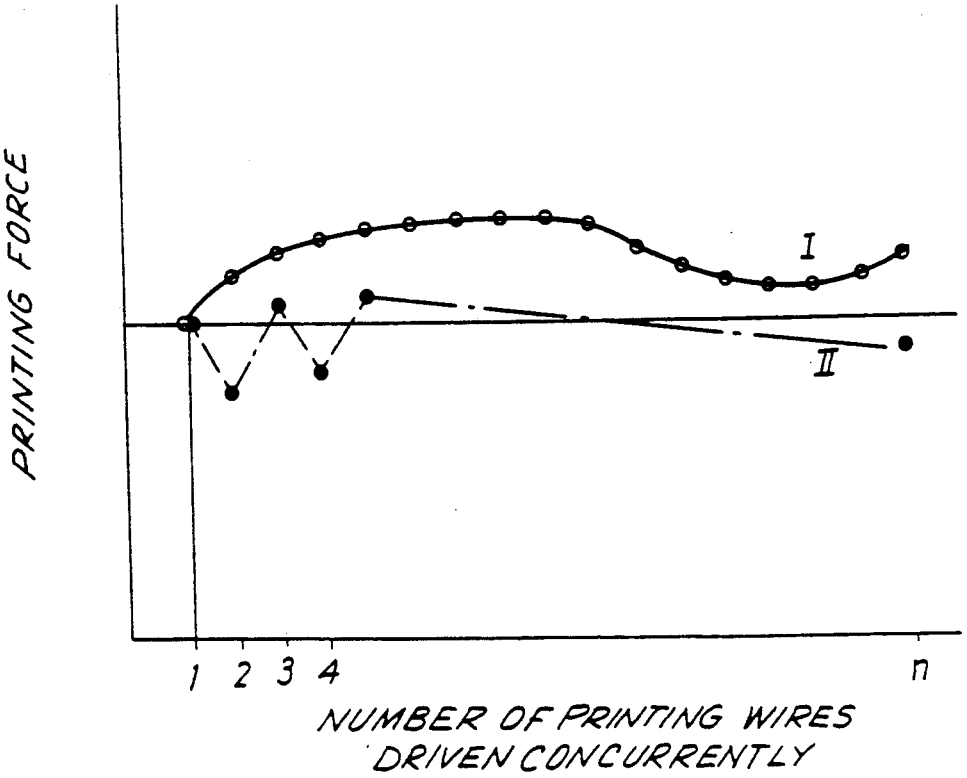

Reference is now made to 18*c* wherein a pattern for driving many print wires 198 concurrently is provided. Cores 110 are divided into groups of three indicated as $C_1, C_2, C_3$. . . The polarity of cores 110 within adjacent groups $C_1$, $C_2$ are set to alternative polarities. Coils 130 within group $C_2$ are excited to the same polarity while the coils of neighboring groups $C_1$, $C_3$ are excited to an inverse polarity. This driving method minimizes mutual magnetic interference between levers 190, thereby obtaining an almost uniform printing force regardless of the number of printing wires to be concurrently driven. As shown in FIG. 19*b*, I represents a printing force of a wire positioned at the center of each group $C_1$, $C_2$, $C_3$ and II represent the driving force of the printing wire positioned on the opposite ends of each group where printing force maintains a high level. The excitation polarity of coil 130 may be simply set and arbitrarily set by changes in the direction of the excitation current to a wire pattern 343 of circuit substrate 340 through a connection shown in FIG. 20 or by changing the turning direction coil 130 about bobbin 132 in direction R, L of the winding forming coil 130 as shown FIG. 21.

Figure 22:
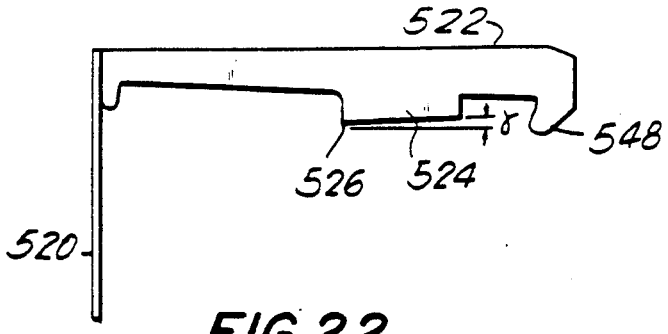
FIG. 22 is a side elevational view of a lever constructed in accordance with a second embodiment of the invention.

Reference is now made FIG. 22 wherein an alternative embodiment of a lever, generally indicated as 522, is provided. Lever 522 is similar to lever 190 having hook rotation support member 548 at one end and a print wire 520 supported at another end. However, a slope having an angle $\gamma$ is formed on an end surface of an armature member 524 so as to bring a end 526 of armature member 524 of lever 522 into contact with core 110 when print wire 520 strikes the platen.

Figure 23:
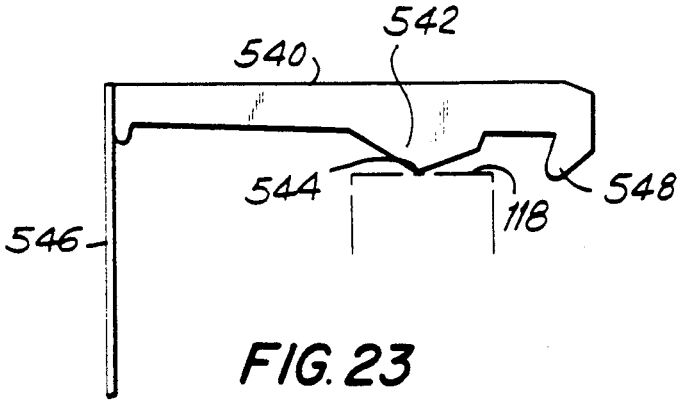
FIG. 23 is a side elevational view of a lever constructed in accordance with a third embodiment of invention.

Reference is now made to FIG. 23 wherein another embodiment of lever 540 being similar in structure to lever 522 is provided. Lever 540 includes a hook rotation support member 548 at one end and supports a print wire 546 at its other end. Lever 540 is provided with a pointed armature member 542 having an angular slope. The point of armature member 542 is brought into contact with core end surface 118 and comes in contact with end 544 thereby leaving a gap between armature portion 542 and end surface 118 when print wire 546 impacts platen 604. In levers 522 and 540, a center of rotation when resetting the lever will shift to armature member 524 and 542 respectively. Accordingly, reset time may be shortened for reasons described in connection with lever 190.

Reference is again made to FIG. 1, where it is shown that a felt ring 370 impregnated with a lubricant is inserted in a space between support retainer spring 210 and second yoke 200. The lubricant contained in felt ring 370 spreads to lubricate a contact point between branches 214 of support retainer spring 210 and lever 190 as a contact point between rotation support member 194 and first yoke 150 and wear resisting ring plate 160, thus minimizing friction at these contacts points.

Reference is now made to FIGS. 2 and 3 in which assembly of a print head 608 in accordance with the invention will be described. Nose 240 is formed as an L-shape when viewed in cross-section at the position disposed opposite platen 604. Guide holes 252 of the nose guide plate 250 are provided in an array consisting of a plurality of rows in accordance with an array of dots to be printed. In an exemplary embodiment, two rows are formed. A lubricant feed port 258 is formed in a portion 256 of nose guide 250 which is externally exposed when inserted into a front end of nose 240. Intermediate third guide plate 300 is inserted to form a predetermined gap between nose guide plate 250 and itself forming a space 304 provided for retaining lubricant therein. Second guide 290 and first guide plate 280 are inserted in that order traveling towards a pedestal 246 of nose 240. A portion of a cylindrical member 249 is coupled to pedestal 246. Cuplike guide member 270 is inserted within cylindrical portion 249 and is charged with a lubricant such as grease or the like. Rear end guide plate 260 is inserted to cover the top of guide member 270 forming a gap therebetween. Guide plates 250, 300 290 and 280 are positioned within grooves 241, 243, 245 and 247 formed in nose 240. Cuplike guide member 270 is placed in a position by a recess 274 which engages with a salient (not shown) within a through hole 248 of nose 240. Rear end guide plate 260 is maintained in position by through hole 264 formed within end guide plate 260 to engage with salient 277 of cuplike guide member 270.

Figure 5:
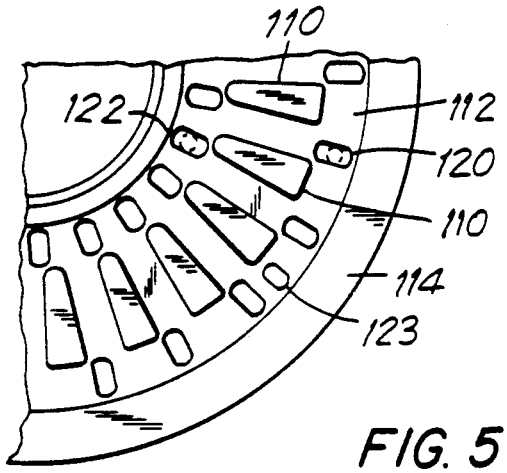
FIG. 5 is a partial top plan view of the frame of the wire dot print head constructed in accordance with the invention.
Figure 20:
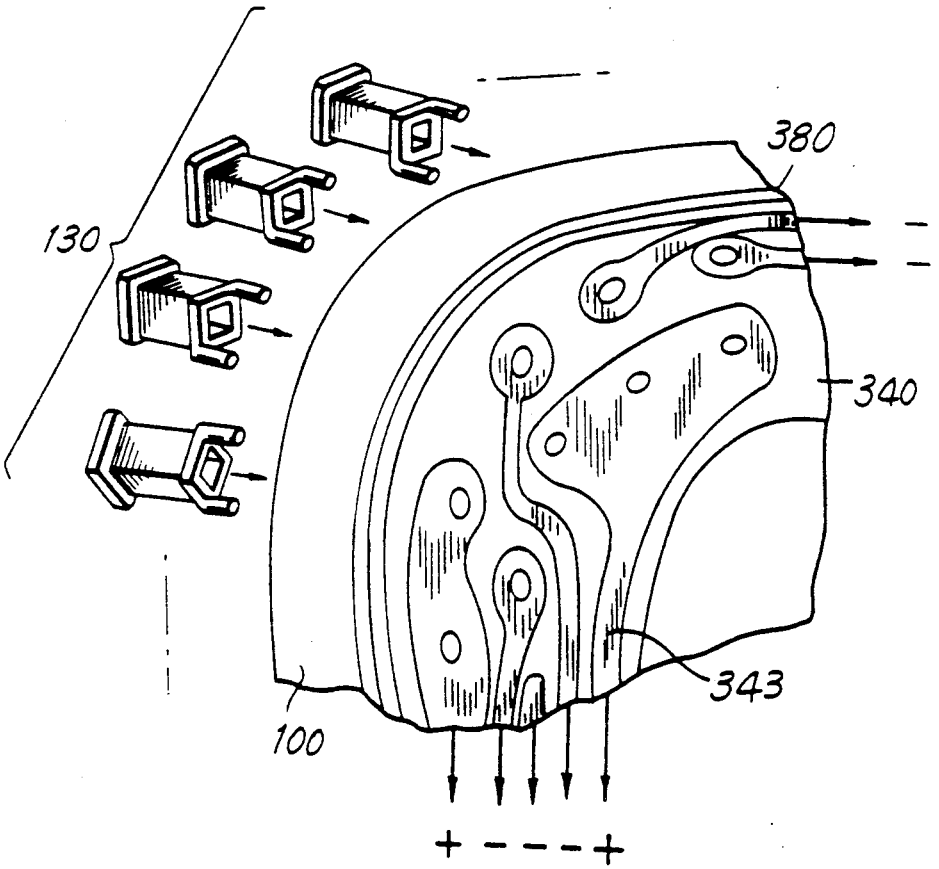
FIG. 20 is a partial exploded view of a circuit substrate in relation to the driving coils constructed in accordance with the invention.
Figure 21A:
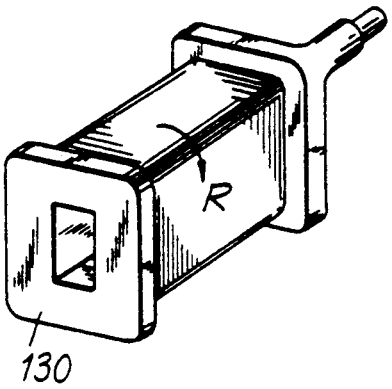
FIGS. 21*a* and 21*b* are perspective views of driving coils constructed in accordance with the invention exemplifying different excitation polarities.
Figure 21B:
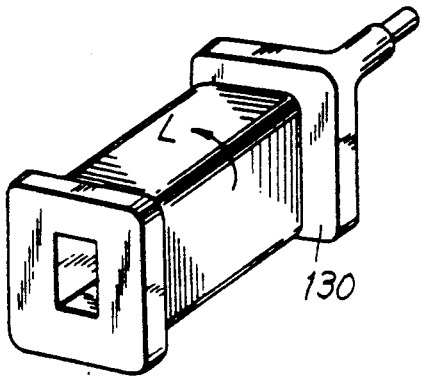

As seen from FIG. 20, coils 130 are inserted on each core 110 of frame 100. An electric insulating plate 380 is provided on frame 100. A circuit substrate 340 is formed on insulating plate 380 and circuit substrate 340 is brought into contact with coils 130. Terminals 142, 144 of coil 130 project to circuit substrates 340 and are soldered to a predetermined pattern 343 formed on circuit substrate 340. Substrate 390 is integrally built upon electric insulating plate 380. Frame 100 constructed as above, is positioned on nose 240 by inserting cylindrical part 249 of nose 240 through hole 106 of frame 100. Salient 241 provided on pedestal 246 and nose 240 pass through a through hole 394 formed on circuit substrate 390 to engage with a positioning hole 123 of frame 100 as seen in FIG. 5, thereby positioning frame 100 relative to nose 240. Spring holder 170 having reset spring 176 already placed therein and spring enclosing hole 17 is then positioned within through hole 106 of frame 100 to build a frame unit 450 shown in FIG. 3.

Accordingly, cuplike guide member 270 is enclosed within nose 240. Rear end guide plate 260 is retained by salient 173 of spring holder 170.

Reference is now more particularly made to FIG. 3 in which a further description for manufacturing wire dot print head 608 is provided. Wear resisting ring plate 160 is placed within frame unit 450 on end surface 114 of outer peripheral wall 102 of frame 100 by matching positioning holes 162 provided on wear resisting ring plate 160 to positioning pins 222 of lever holder 220. First yoke 150 is placed on ring plate 160 by aligning positioning holes 156 with positioning holes 162. Ring plate 160 may be further guided by the interior of heat sink member 320. As a result, the space which encloses each lever 190 is defined by guide groove 180 of spring holder 170 and recess 152 of first yoke 150.

At this stage of manufacturing, lever 190 is dropped onto frame unit 450 so that print wire 198 faces in the direction of guide hole 262 of rear end guide plate 260 and guide hole 252 of nose guide plate 250. Because guide holes 252, 272, 282, 292, 302 of guide plates 250, 270, 280, 290 and 300 are disposed in a straight line, print wire 198 is linearly admitted to guide hole 252 of nose guide plate 250. Thus, lever 190 is positioned in guide groove 180 of spring holder 170 at its print wire bearing end and supported by reset spring 176.

When second yoke 200 is placed on first yoke 150 so that positioning hole 206 matches positioning hole 156 of first yoke 150, lever 190 will be retained in a gap between branches 204. Accordingly, lever 190 is pressed by ring member 202 of second yoke 200 and rotation support member 194 is inserted between recess 152 of first yoke 150 and wear resisting ring plate 160. With lever 190 thus positioned, a damper spacer 412, a damper rubber 414 and damper spacer 416 comprising damper member 410 are inserted in guide piece 182 of spring holder 170 in that order and positioned on the print wire bearing end of lever 190 as shown in FIG. 24.

In this state of manufacture, levers 190 are supported by a side wall of branch 240 of second yoke 200 and guide groove 180 of spring holder 170 radially arrayed at regular intervals and damper member 410 positioned on the print wire supporting end thereof. Next, felt ring 370, impregnated with a lubricant, is placed upon the structure. As seen in FIG. 7, when supporting retainer spring 210 is placed on second yoke 200 with positioning hole 216 matched to positioning pin 184 of spring holder 170, a tip of branch 214 is positioned between branches 204 of second yoke 200 to come in contact with an upper end of rotation support member 194 of lever 190. Felt ring 370 is now surrounded by second yoke 200 and supporting retainer spring 210 keep it from falling off.

Lever holder 220 is positioned with positioning pins 222 formed on outer peripheral wall 224 aligned with positioning holes 162, 156, 206 a wear resisting ring plate 160, first yoke 150 and second yoke 200 as well as positioning holes 228 formed on cover plate 226 which is itself positioned relative to positioning pin 184 of spring holder 170. Thus, the end surface of outer peripheral wall 224 of lever holder 220 is brought into contact with branch 204 of second yoke 200 and cover plate 226 of lever holder 220 is brought into contact with a tip of salient 178 of spring holder 170. Positioning pin 222 of outer peripheral wall 224 is positioned within positioning holes 162, 156, 206 of wear resisting plate 160, first yoke 150 and second yoke 200 for circumferential positioning.

Figure 25:
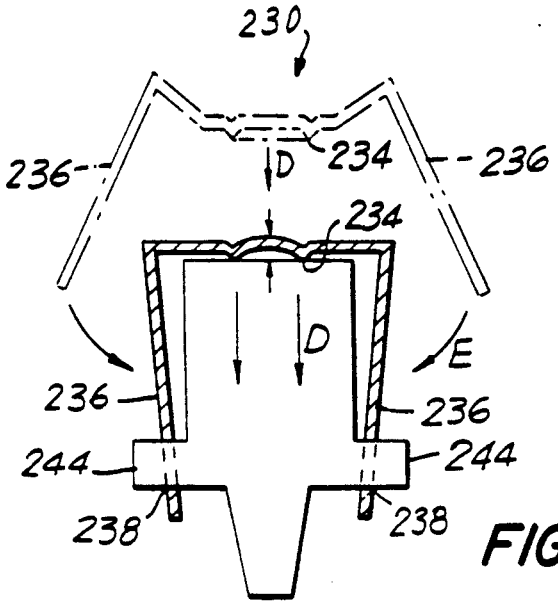
FIG. 25 is a sectional schematic view representing a method for positioning a spring in accordance with the invention.

A tip of salient 182 of spring holder 170 is positioned in a hole 229 of lever holder 220 so that it will never contact with cover plate 226. Reinforcing plate 400 is then placed on a surface of lever holder 220. As shown in FIG. 25, a fixed spring 230 has legs 236 extending downward from respective sides of a rib section 234. Fixed spring 230 is placed on nose 240 by placing spring 230 in the direction of arrow D, and moving legs 236 in the direction of arrows E so that spring 230 is positioned through a recess 227 of cover plate 226 and a window 238 receives projection 244 of nose 240. Since lever holder 220 has a central portion of cover plate 226 pushed toward nose 240 through rib part 234 of fixed spring 230 and reinforcing plate 400, branches 214 of supporting retainer spring 210 press rotation support member 194 of lever 190 towards first yoke 150 and wear resisting ring plate 160 with a constant pressure. Fixed spring 230 only contacts lever holder 220 through rib part 234 formed at the central portion thereof as seen in FIG. 25. The central portion of lever holder 220 is subjected to a uniform pressure and pushed uniformly towards positioning pin 184 of spring holder 170 regardless of the strain of fixed spring 230.

As seen in FIG. 17, lever holder 220 is formed with a shallow ring indent 225 provided near a central portion of lever holder 220 which is formed to provide clearance for ring member 212 of supporting retainer spring 210. Thus, any strain within ring member 212 of supporting retainer spring 210 is absorbed by the clearance and branches 214 will accordingly push lever 190 at a constant force.

Cuplike guide member 270 and rear end guide plate 260 are positioned within through hole 248 of nose 240 and are held in place by cover 226 of lever holder 220 acting against spring holder 170 as shown in FIG. 17. Spring holder 170 is pressed by cover 226 of lever holder 220. Ring plate 160, first yoke 150 and second yoke 200 are placed in a position by positioning pin 222 and resiliently pressed towards outer peripheral wall 224 of lever 220.

When the above assembly is completed, branch 204 of second yoke 200 and salient 154 of first yoke 150 contact each other, a magnetic flux generated through coil 130 passes through a first magnetic circuit which comprises core 110 of frame 100 armature member 196 of lever 190, rotation support member 194, outer peripheral wall 102, bottom 112 and a second magnetic circuit which includes core 110, armature member 196, branches 204 of second yoke 200, salient 154 of first yoke 150, peripheral wall 102 of frame 100, bottom 112 of frame 100 and then efficiently attracts lever 190 towards core 110.

When the assembly of wire dot print head 608 is complete, a lubricant such as grease or the like is fed into space 304 between nose guide plate 250 and third guide plate 300 through feed port 254 of nose guide plate 250 utilizing a syringe or the like. Feed port 254 is then sealed. As described above, each member positioned between frame 100 and lever holder 220 is dropped and placed making most of the manufacturing process applicable to automatic assembly. Then, during assembly inspection, if a print wire stroke must be adjusted, fixed spring 230 is removed from nose 240. Next, lever holder 220 is removed and the number of spacers 416 which make up damper member 410 will be changed thus simply adjusting the stroke length.

By providing a wire dot print head having a frame formed of a magnetic material having an inner peripheral wall and outer peripheral wall with a plurality of cores formed between the walls about the circumference of the frame and a driving a coil mounted about each core having an upper end extending above an end surface of the core and a first yoke formed of a magnetic material disposed on the outer peripheral wall of the frame and having a recess formed therein so that a lever formed with a hook end forming a rotation support member and a second end, a print wire fixed at the second end of the lever and the rotation support member of the lever engaging the recess of the first yoke forming a center of rotation, a print head is provided utilizing levers which do not need to rotate about a pivot shaft. This allows higher integrated density for the lever elements.

It will thus be seen that the objects set forth above, among those apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language might be said to fall therebetween.

What is claimed is:

1. A wire dot printer having a printing wire driving device, comprising:

(a) a frame formed of a magnetic material having a circumference, an inner peripheral wall and an outer peripheral wall, said frame being provided with a plurality of cores having an end surface disposed within said outer peripheral wall at regular intervals about said circumference, said outer peripheral wall and end surfaces of the cores being coplanar;

(b) a plurality of driving coils supported about a respective core of said plurality of cores each having an upper end projecting above said end surfaces of said cores, said end surface of said cores being coplanar with a top of said outer peripheral wall;

(c) a first yoke formed of a magnetic material, at least two salients formed on said first yoke to form a recess therebetween within said first yoke, the recess being positioned to correspond to a position of said cores, said first yoke being disposed on said outer peripheral wall of said frame;

(d) lever means for supporting a print wire having a center projecting portion integrally formed with a first end hooked to form a rotation support member, said center projecting portion of said lever means forming an armature member extending within said coil, a second end, said lever means being formed of a magnetic material, and a printing wire being fixed on the second end, said rotation support member being engaged within said recess of said first yoke, said rotation support member being resiliently pressed against the top of the outer peripheral wall and an inner wall surface formed by said recess of said first yoke; and (e) a second yoke formed of a magnetic material having a ring member, a plurality of branches coupled to said ring member and extending radially therefrom, each of said branches being built up on a respective one of said salients of said first yoke when placed on said first yoke said lever means being disposed between two adjacent branches.

2. The wire dot printer as defined in claim 1, further comprising a ring plate consisting of a wear resisting material, said ring plate being interposed between an end surface of said outer peripheral wall and said first yoke means.

3. The wire dot printer as defined in claim 1, wherein a wear resisting metallic layer is formed on an end surface of said frame.

4. The wire dot printer as defined in claim 1, having a lubricant layer on the rotation support member of said lever means and said recess of said first yoke.

5. The wire dot printer as defined in claim 1, wherein said end surfaces of said cores have a lubricant layer.

6. The wire dot printer as defined in claim 1, further comprising a coil bobbin, said coil bobbin including a circumferential wall which is formed thinner than a radial wall.

7. The wire dot printer of claim 1, wherein said ring member is disposed on an upper surface of said plurality of branches and said lever means is disposed on a lower portion of said ring member whereby, the lever means is disposed within the recess of said first yoke and pressed towards the ring member.

8. The wire dot printer of claim 1, wherein a radial branch of said supporting retainer spring means contacts the second end of said lever means so that said lever means is pressed against an inner wall surface of said first yoke by a horizontal component of a thrust force and against a surface of the frame by a vertical component of said thrust force provided by said branch.

9. The wire dot printer as defined of claim 8, wherein an end portion of said lever means is inserted in said groove of said spring holder means.

10. A wire dot printer having a printing wire driving device, comprising:

(a) a frame formed of a magnetic material having a circumference an inner peripheral wall and an outer peripheral wall, a plurality of cores disposed between said inner peripheral wall and said outer peripheral wall at regular intervals about said circumference, said inner peripheral wall, outer peripheral wall and cores each having end surfaces, the end surfaces being coplanar;

(b) a plurality of driving coils mounted about said cores said coils having upper ends projecting above said end surfaces of said cores;

(c) a first yoke formed of a magnetic material having at least two salients formed thereon forming a recess within said first yoke, the recess being positioned to correspond to a position of said cores, said first yoke being disposed on the outer peripheral wall of said frame;

(d) a lever having a first hooked end forming a rotation support member, a central projecting portion forming an armature member, a second end, a printing wire being fixed on said second end, said rotation support member being engaged within said recess of said first yoke;

(e) a second yoke formed of a magnetic material having a ring member, a plurality of branches coupled to said ring member and extending radially therefrom, each of said branches being built up on a respective one of the salients of said first yoke when placed on said first yoke;

(f) supporting retainer spring means having a plurality of radial springs, said radial springs coming in contact with said rotation support member of said lever for resiliently biasing said rotation support member within said frame;

(g) a nose for guiding said printing wire to a front end;

(h) lever holder means for biasing said supporting retainer spring means, said lever holder means being fixed on the nose; and (i) said coils being grouped in adjacent sets of three, said coils in a single group of coils being of a same polarity and the coils belonging to adjacent sets of said coils being of opposite polarities.

11. The wire dot printer as defined in claim 10, wherein said polarities are determined in accordance with the direction in which the coils are wound.

12. The wire dot printer as defined in claim 10, wherein said polarities are determined in accordance with wiring to the coils.

13. A wire dot printer having a printing wire driving device, comprising:

(a) a frame formed of a magnetic material, having a circumference, an inner peripheral wall and an outer peripheral wall, a plurality of cores disposed between said inner peripheral wall and said outer peripheral wall at regular intervals about said circumference, said inner peripheral wall, outer peripheral wall and cores having respective end surfaces, the end surfaces being coplanar;

(b) driving coils mounted about said cores having upper ends projecting above said end surfaces of said cores;

(c) a first yoke formed of a magnetic material, at least two salients formed on said first yoke forming a recess being positioned to correspond to a position of said cores, and a positioning hole formed therein;

(d) spring holder means for holding a spring being insertable within an inner peripheral wall of said cores having a groove formed therein at a position opposed to said cores; a spring inserted within the groove;

(e) lever means for supporting a printing wire having a first hooked end forming a rotation support member, a central projecting portion forming an armature member, a second end, a printing wire fixed on said second end, said rotation support member being engaged within said recess of said first yoke;

(f) a second yoke formed of a magnetic material having a ring member, a plurality of branches coupled to said ring member and extending radially therefrom, and a positioning hole formed therein, each of said branches being built up on a respective one of said salients of said first yoke when placed on said first yoke;

(g) supporting retainer spring means having a plurality of radial spring, said radial springs coming in contact with said rotation support member of said lever means for resiliently biasing said rotation support member within said frame;

(h) a nose for guiding the printing wire to a front end;

(i) lever holder means adapted to be elastically deformed for resiliently biasing said supporting retainer spring means, a positioning projection extending from the outer periphery of the lever holder means and engaging with said positioning holes of said first yoke and second yoke, said positioning holes being formed at an outer periphery of said first and second yoke respectively; and (j) a fixed spring for fixing said lever holder means on said nose.

14. The wire dot printer as defined in claim 13, wherein said spring holder means comprises a positioning pin, said positioning pin extending to the lever holder means, and said lever holder means having a positioning hole formed therein for receiving said pin.

15. The wire dot printer as defined in claim 13, wherein said lever holder means includes a cover and said fixed spring comprises a rib formed on a surface of said fixed spring opposite said cover and projecting towards said lever holder means.

16. The wire dot printer as defined in claim 13, further comprising a reinforcing plate disposed between said fixed spring and said lever holder means.

17. The wire dot printer as defined in claim 13, further comprising a first leg and second leg, a claw outwardly projecting from each leg and radiating means for radiating the heat generated by said wire dot printer fixed thereon through said claws.

18. The wire dot printer of claim 13, wherein said positioning holes of the first and second yokes are each formed as grooves provided at the outer peripheral end of said first yoke and second yoke respectively.

* * * * *